US012007174B2

(12) United States Patent
Yates

(10) Patent No.: US 12,007,174 B2
(45) Date of Patent: Jun. 11, 2024

(54) PARABOLICALLY DEFORMING SECTOR PLATE

(71) Applicant: HOWDEN GROUP LIMITED, Scotland (GB)

(72) Inventor: James Yates, Edinburgh (GB)

(73) Assignee: HOWDEN GROUP LIMITED, Renfrew (GB)

( * ) Notice: Subject to any disclaimer, the term of this patent is extended or adjusted under 35 U.S.C. 154(b) by 0 days.

(21) Appl. No.: 17/983,086

(22) Filed: Nov. 8, 2022

(65) Prior Publication Data

US 2023/0073822 A1 Mar. 9, 2023

Related U.S. Application Data

(63) Continuation of application No. PCT/IB2020/054525, filed on May 13, 2020.

(51) Int. Cl.
*F28D 19/04* (2006.01)
*F28F 27/00* (2006.01)

(52) U.S. Cl.
CPC ..... *F28D 19/047* (2013.01); *F28F 27/006* (2013.01)

(58) Field of Classification Search
CPC ..... F28D 19/047; F28F 27/006
USPC ..... 165/9
See application file for complete search history.

(56) References Cited

U.S. PATENT DOCUMENTS 2,873,952 A * 2/1959 Firgau ..... F28D 19/047 165/DIG. 22
3,073,384 A * 1/1963 Horn ..... F28D 19/047 165/9
3,100,014 A 8/1963 Flurschutz
3,166,118 A 1/1965 Koch
3,246,686 A 4/1966 Kalbfleisch et al.
3,372,736 A 3/1968 Brandt et al.
(Continued)

FOREIGN PATENT DOCUMENTS

CN 101726206 A 6/2010
CN 105180203 A 12/2015
(Continued)

OTHER PUBLICATIONS

Korean Office Action for Application No. 10-2016-0156222 and machine translation, dated Mar. 8, 2018, 11 pages.
(Continued)

*Primary Examiner* — Jon T. Schermerhorn, Jr.
(74) *Attorney, Agent, or Firm* — Edell, Shapiro & Finnan, LLC

(57) ABSTRACT

A method for producing a sector plate for a rotary heat exchanger is disclosed. The method includes defining overall dimensions of a sector plate. A number of a plurality of tapered ribs to be included on the top surface is determined based on a surface area of the sector plate and/or a sealing to be provided by the sector plate. Additionally, a root height of the plurality of tapered ribs is determined based on at least a plate thickness of the sector plate and the number of the plurality of tapered ribs. With the root height, the plurality of tapered ribs cause the sector plate to deform parabolically in response to an actuation. The plurality of tapered ribs also return the sector plate to a rest position and the sector plate supports its weight in a cantilevered fashion when in the actuated position and the rest position.

20 Claims, 18 Drawing Sheets

(56) References Cited

U.S. PATENT DOCUMENTS

| | | | | |
|---|---|---|---|---|
| 3,786,868 | A | 1/1974 | Finnemore | |
| 3,891,030 | A | 6/1975 | Schluter et al. | |
| 4,122,891 | A | 10/1978 | Baker | |
| 4,124,063 | A | 11/1978 | Stockman | |
| 4,206,803 | A | 6/1980 | Finnemore et al. | |
| 4,219,069 | A | 8/1980 | Stockman | |
| 4,298,055 | A | 11/1981 | Ritter | |
| 4,593,750 | A | 6/1986 | Finnemore | |
| 4,773,145 | A | 9/1988 | Baker et al. | |
| 5,038,849 | A | 8/1991 | Hagar | |
| 5,063,993 | A | 11/1991 | Huston | |
| 5,363,903 | A * | 11/1994 | Hagar | F28D 19/047 165/8 |
| 5,443,113 | A * | 8/1995 | Mulholland | F28G 9/005 165/8 |
| 5,615,732 | A | 4/1997 | Brophy et al. | |
| 5,628,360 | A * | 5/1997 | Brophy | F28D 19/047 165/DIG. 21 |
| 5,697,619 | A | 12/1997 | Fierle | |
| 5,915,339 | A | 6/1999 | Cox et al. | |
| 5,915,340 | A | 6/1999 | Cronin et al. | |
| 5,950,707 | A | 9/1999 | Kozacka et al. | |
| 6,091,061 | A | 7/2000 | Dreisler et al. | |
| 6,119,764 | A | 9/2000 | Karlsson et al. | |
| 6,227,150 | B1 | 5/2001 | Finnemore et al. | |
| 6,260,607 | B1 | 7/2001 | Finnemore | |
| 6,279,647 | B1 * | 8/2001 | Karlsson | F28F 27/006 376/245 |
| 6,345,442 | B1 | 2/2002 | Fierle et al. | |
| 6,397,785 | B1 | 6/2002 | Fierle | |
| 6,422,298 | B1 | 7/2002 | Rhodes et al. | |
| 6,505,679 | B2 | 1/2003 | Larkin et al. | |
| 6,581,676 | B2 | 6/2003 | Fierle et al. | |
| 6,615,905 | B2 | 9/2003 | Rhodes et al. | |
| 6,672,369 | B1 | 1/2004 | Brophy et al. | |
| 6,789,605 | B1 * | 9/2004 | Kaser | F23L 15/02 165/8 |
| 7,059,386 | B1 | 6/2006 | Kaser | |
| 7,416,016 | B1 | 8/2008 | Kaser | |
| 8,157,266 | B2 | 4/2012 | Klisura | |
| 8,776,864 | B2 | 7/2014 | Klisura | |
| 10,295,273 | B2 | 5/2019 | O'Boyle | |
| 11,333,446 | B2 * | 5/2022 | O'Boyle | F23L 15/02 |
| 2009/0145574 | A1 | 6/2009 | Klisura | |
| 2013/0105105 | A1 | 5/2013 | O'Brien | |
| 2013/0327495 | A1 | 12/2013 | Hastings | |
| 2017/0051983 | A1 | 2/2017 | O'Boyle | |
| 2019/0249930 | A1 | 8/2019 | O'Boyle | |

FOREIGN PATENT DOCUMENTS

| | | | |
|---|---|---|---|
| CN | 104613493 | B | 3/2017 |
| CN | 206131046 | U | 4/2017 |
| CN | 107062965 | A | 8/2017 |
| EP | 0599577 | A1 | 6/1994 |
| EP | 807238 | B1 | 1/2001 |
| EP | 3171117 | B1 | 5/2018 |
| GB | 2400646 | A | 10/2004 |
| JP | S4810736 | B | 4/1973 |
| JP | 60251391 | A | 12/1985 |
| JP | 61225583 | A | 10/1986 |
| JP | H1183362 | | 3/1999 |
| KR | 100580854 | | 5/2006 |
| KR | 1020170059906 | | 5/2017 |
| TW | 513534 | B | 12/2002 |

OTHER PUBLICATIONS

International Search Report and Written Opinion for PCT App. No. PCT/IB2020/054525, dated Dec. 21, 2020, 12 pages.

* cited by examiner

600

| Project | Size | Type | Sealing Arrangement | METHOD OF ADJUSTING SECTORPLATES | | | | | | | | |
|---|---|---|---|---|---|---|---|---|---|---|---|---|
| | | | | Cold End Sensor Control | | | Duct Temperature Control | | | Sector Plate 400 (Values in brackets are with Contact Seals) | | |
| | | | | HE Radial Leakage | Total Leakage | % | HE Radial Leakage | Total Leakage | % | HE Radial Leakage | Total Leakage | % |
| Retrofit 1 | 29.0 | VAT | PA-Gas, SA-Gas = Tripple; PA-SA = Double | 2.273 | 11.706 | 5.45 | 2.518 | 11.951 | 5.57 | 2.274 (0.279) | 11.707 (9.708) | 5.46 (4.52) |
| Retrofit 2 | 31.5 | VAT | Double throughout | 4.183 | 17.32 | 4.99 | 5.361 | 18.498 | 5.33 | 3.86 (0.427) | 17.012 (13.579) | 4.9 (3.91) |
| Install 1 | 33.5 | VAT | Quadruple throughout | 6.326 | 21.262 | 4.3 | 7.797 | 22.733 | 4.59 | 5.389 (0.533) | 20.325 (15.469) | 4.11 (3.13) |
| Install 2 | 34.0 | VAT | PA-Gas, SA-Gas = Triple; PA-SA = Double | 5.221 | 23.842 | 5.33 | 6.078 | 24.699 | 5.52 | 5.017 (0.453) | 23.639 (19.075) | 5.29 (4.27) |
| Install 3 | 34.0 | VAT | Double throughout | 5.345 | 20.548 | 4.85 | 6.483 | 21.686 | 5.12 | 4.983 (0.497) | 20.187 (15.701) | 4.76 (3.71) |

FIG. 20

PARABOLICALLY DEFORMING SECTOR PLATE

CROSS REFERENCE TO RELATED APPLICATIONS

This application is a continuation of International (PCT) Patent Application No. PCT/IB2020/054525, filed May 13, 2020, and entitled "Parabolically Deforming Sector Plate," the entire disclosure of which is incorporated herein by reference.

FIELD OF INVENTION

The present invention relates to the field of rotary heat exchangers and, in particular, to deforming sector plates that reduce gas leakage in rotary heat exchangers.

BACKGROUND

Rotary heat exchangers, which are also known as thermal wheels, rotary air-to-gas enthalpy wheels, rotary regenerative heat exchangers, or heat recovery wheels, are often deployed to recover heat energy from exhaust gases of industrial processes. These heat exchangers can have two or more sectors (e.g., bi-sector, tri-sector, quad-sector, et.) and rotate a drum-shaped rotor with a honeycomb-style matrix of heat absorbing material within a housing to transfer heat from hot gas passing through one or more hot sectors to cold gas passing through one or more cold sectors.

This heat transfer preheats intake gasses for industrial processes, providing a large increase in efficiency for the industrial process. However, inherent leakage issues caused by higher-pressure air leaking to the lower pressure flue gas increases the draft fan power, slightly reducing the efficiency gains provided by a heat exchanger. Moreover, leakage reduction may also minimize emissions by reducing the gas mass flow being handled, thereby improving the efficiency of the downstream emissions reduction equipment.

In view of the foregoing, methods, apparatuses, and systems that improve (e.g., minimize) radial seal leakage are desirable. As an example of a solution that attempts to reduce radial seal leakage, European Patent No. 3171117 B1 provides sector plates for a regenerative heat exchanger. Each sector plate includes three tapered ribs (two ribs on outer edges of the sector plates and one rib in the middle, between the two ribs on the outer edges) that create a constant moment of inertia along a radial dimension of the sector plate.

This constant moment of inertia causes the sector plates to deform spherically response in response to a downward actuation at an outer end of the sector plates. Unfortunately, this does not match typical rotor turndown profiles, which are often parabolic. Consequently, European Patent No. 3171117 B1 uses two actuators or adjusting devices—one pushing down at an outer end of the sector plate and one pulling up on a middle portion of the sector plates—to further deform its sector plates in an attempt to try to match radial turndown of a rotor. These actuators support the sector plate (e.g., hold the sector plate in a rest position) and can push or pull on the sector plate to actuate the sector plate.

Unfortunately, increasing the number of actuators in a system creates more potential for error while also increasing the operational complexity of the system, which may increase maintenance, installation, and operation costs (e.g., since control systems must control and coordinate actions of multiple actuators). Moreover, as the number of actuators increases, more complex operational systems must be carefully tuned for different heat exchangers (e.g., since different heat exchangers have different operational characteristics that cause different turndown profiles and/or require sector plates of different sizes). Thus, methods, apparatuses, systems, and/or techniques that improve (e.g., minimize) radial seal leakage while minimizing operational complexity and potential for error are desired.

SUMMARY

The present invention relates to a sector plate for a rotary regenerative heat exchanger and design techniques for designing the sector plates. In accordance with at least one embodiment of the present invention, a sector plate is presented herein. The sector plate includes a bottom surface and a top surface. The bottom surface is configured (e.g., sized and shaped) to be positioned across a radial dimension of a rotor of a rotary heat exchanger so that the bottom surface can form one or more seals with one or more radial plates of the rotor during operation of the rotor. The top surface includes a plurality of tapered ribs sized to cause the sector plate to parabolically deform to an actuated position in response to an actuation load acting in a downward direction. The parabolic deformation minimizes a running gap between the bottom surface and the one or more radial plates. The plurality of tapered ribs also return the sector plate to a rest position in response to removal of the actuation load and, during operations of the heat exchanger, the sector plate supports its weight in a cantilevered fashion when in the actuated position and when in the rest position.

Thus, advantageously, the sector plate need not be supported at its distal end and can be installed easily and at minimal cost. Also, since the sector plate is not supported at its distal end, it can be manufactured inexpensively, at least because complicated bearings, cooling systems, and/or lubrication systems are not required. Still further, since the tapered ribs cause a parabolic deformation, the sector plate can be actuated downwards at a single location (e.g., along a single arc or annular section) and a set of actuators need not pull upwards and push downwards simultaneously in different locations along a length of the sector plate.

In accordance with other embodiments, a rotary heat exchanger is presented herein. The rotary heat exchanger includes a housing with a cylindrical portion, a rotor hub disposed with the cylindrical portion to define an annular space between the cylindrical housing and the rotor hub, a rotor disposed in and configured to rotate within the annular space, and a sector assembly. The rotor includes radial plates and the sector assembly divides the annular space into two or more sectors and includes at least two sector plates coupled to the rotor hub. Each of the at least two sector plates includes a bottom surface and a top surface. The bottom surface is configured to form one or more seals with one or more of the radial plates of the rotor during rotation of the rotor. The top surface includes a plurality of tapered ribs sized to cause the sector plate to parabolically deform to an actuated position in response to an actuation load. The parabolic deformation minimizes a running gap between the bottom surface and the one or more radial plates. Additionally, the plurality of tapered ribs return the sector plate to a rest position in response to removal of the actuation load, and, during operations of the rotary heat exchanger, the sector plate supports its weight in a cantilevered fashion when in the actuated position and the rest position.

In accordance with other embodiments, a method for producing a sector plate for a rotary heat exchanger is presented herein. The method includes defining overall dimensions of a sector plate that define a surface area of a top surface and a bottom surface of the sector plate, the bottom surface being configured to be positioned across a radial dimension of a rotor of a rotary heat exchanger so that the bottom surface can form one or more seals with one or more radial plates of the rotor during operation of the rotor. Then, a number of a plurality of tapered ribs to be included on the top surface is determined based on the surface area and/or a desired sealing to be provided between the one or more radial plates and the bottom surface. Additionally, a root height of the plurality of tapered ribs is determined based on at least a plate thickness of the sector plate and a number of the plurality of tapered ribs, such that with the root height, the plurality of tapered ribs cause the sector plate to parabolically deform to an actuated position in response to an actuation load. This parabolic deformation minimizes a running gap between the bottom surface and the one or more radial plates. Additionally, the plurality of tapered ribs return the sector plate to a rest position in response to removal of the actuation load and the sector plate supports its weight in a cantilevered fashion when in the actuated position and the rest position.

Among other advantages, this method allows for customized design of sector plates on a case-by-case basis. Thus, sector plates designed in accordance with the method presented herein may minimize the running gap for rotary regenerative heat exchangers of different sizes or capacities and/or for rotary regenerative heat exchangers operating under different conditions. That is, sector plates designed in accordance with the method presented herein may be customized across a variety of temperature differentials.

In some embodiments of the above method, the number of the plurality of ribs is capped at three for double sealing or quadruple sealing and the number of the plurality of ribs is capped at five for triple sealing or sextuple sealing. Additionally or alternatively, the determining of the root height may also be based on a material. The material, the surface area, and the plate thickness can be used to calculate a weight of the sector plate. Notably, the weight of the sector plate may unsupported at a distal end of the sector plate during operations of a rotary heat exchanger. Still further, in some instances, the root height and/or the number of the plurality of tapered ribs may control a stiffness of the sector plate, thereby controlling the parabolic deformation that minimizes the running gap. Advantageously, this allows the sector plate to deform parabolically in accordance with various rotor turndown profiles, across regenerative heat exchangers of different sizes and specification without requiring actuation systems to be redesigned across heat exchangers.

In some of these embodiments, the defining the overall dimensions of the sector plate includes determining the overall dimensions based on: (a) a sealing arrangement to be provided in the rotary heat exchanger; (b) a number of sections included in the rotary heat exchanger; (c) a size of the rotary heat exchanger; or (d) any combination of (a), (b), and (c) (e.g., (a) and (b), (a) and (c), (b) and (c), or (a), (b), and (c)). Thus, the sector plates may be compatible with heat exchangers that require single sealing, double sealing, triple sealing, quadruple sealing, etc. as well as heat exchangers that include two sections, three sections, four sections, etc. (with each section having an inlet and an outlet).

Additionally or alternatively, the method may include defining a fixed section and a cantilevered section. The fixed section extends from a first end of the sector plate that engages a rotor hub of the rotary heat exchanger. The cantilevered section extends from the fixed section to a distal end of the sector plate and the plurality of tapered ribs extend radially through at least a portion of the cantilevered section. Moreover, the sector plate may include a first edge and a second edge and the method may include arranging the plurality of tapered ribs to be equally spaced between the first edge and the second edge. For example, the sector plate may be a sector of a circle so that the first edge and the second edge are angled outwardly with respect to a central longitudinal axis of the sector plate and each of the plurality of ribs may extend radially through the sector. Equal spacing may provide relatively constant stiffness across lateral axes or lateral arcs spanning the sector plate.

In some embodiments, the actuation load acting on the sector plate acts only in a downward direction. In some instances, the method defines the actuation section disposed at a distal end of the top surface and the actuation section is configured to receive the actuation load. For example, the actuation section may include one or more actuation points that are equally spaced between traverse ribs that extend through or between the plurality of tapered ribs. In some instances, the one or more actuation points are a pair of actuation points that are equally spaced from the two lateral ribs and also equally spaced from a first edge and a second edge of the sector plate. In some instances, the plurality of tapered ribs may terminate at one of the two traverse ribs disposed closer to a proximal end of the sector plate. Additionally or alternatively, the sector plate may be a sector of a circle and the actuation section may comprise an arc or annular section of the sector.

Regardless of how exactly the actuation section is defined, actuating the sector plate is one location along its length (e.g., along a single arc or arc-shaped section) allows the sector plate to be deformed with a single actuator (or actuator assembly) and relatively uncomplicated control system. It also reduces the number of potential failure points. That said, arranging the actuation points in specific locations may also distribute the actuation force evenly across the sector plates and spacing the actuation points with respect to transverse ribs may ensure that a downward actuation does not unwantedly deform the sector plate.

According to still other embodiments, an apparatus and a computer program product (e.g., computer readable storage media) for producing sector plates are presented herein. The apparatus includes a processor that can execute the method laid out above and the computer program product comprises one or more computer readable storage that are executable by a processor to cause the processor to execute the method laid out above. Thus, the apparatus and computer program product may each achieve the benefits of the system and method laid out above.

BRIEF DESCRIPTION OF THE DRAWINGS

To complete the description and in order to provide for a better understanding of the present invention, a set of drawings is provided. The drawings form an integral part of the description and illustrate an embodiment of the present invention, which should not be interpreted as restricting the scope of the invention, but just as an example of how the invention can be carried out. The drawings comprise the following figures:

FIG. 20 is a table illustrating tabulated values for predicted leakage of known sector plates and the sector plate presented herein.

DETAILED DESCRIPTION

Figure 1:
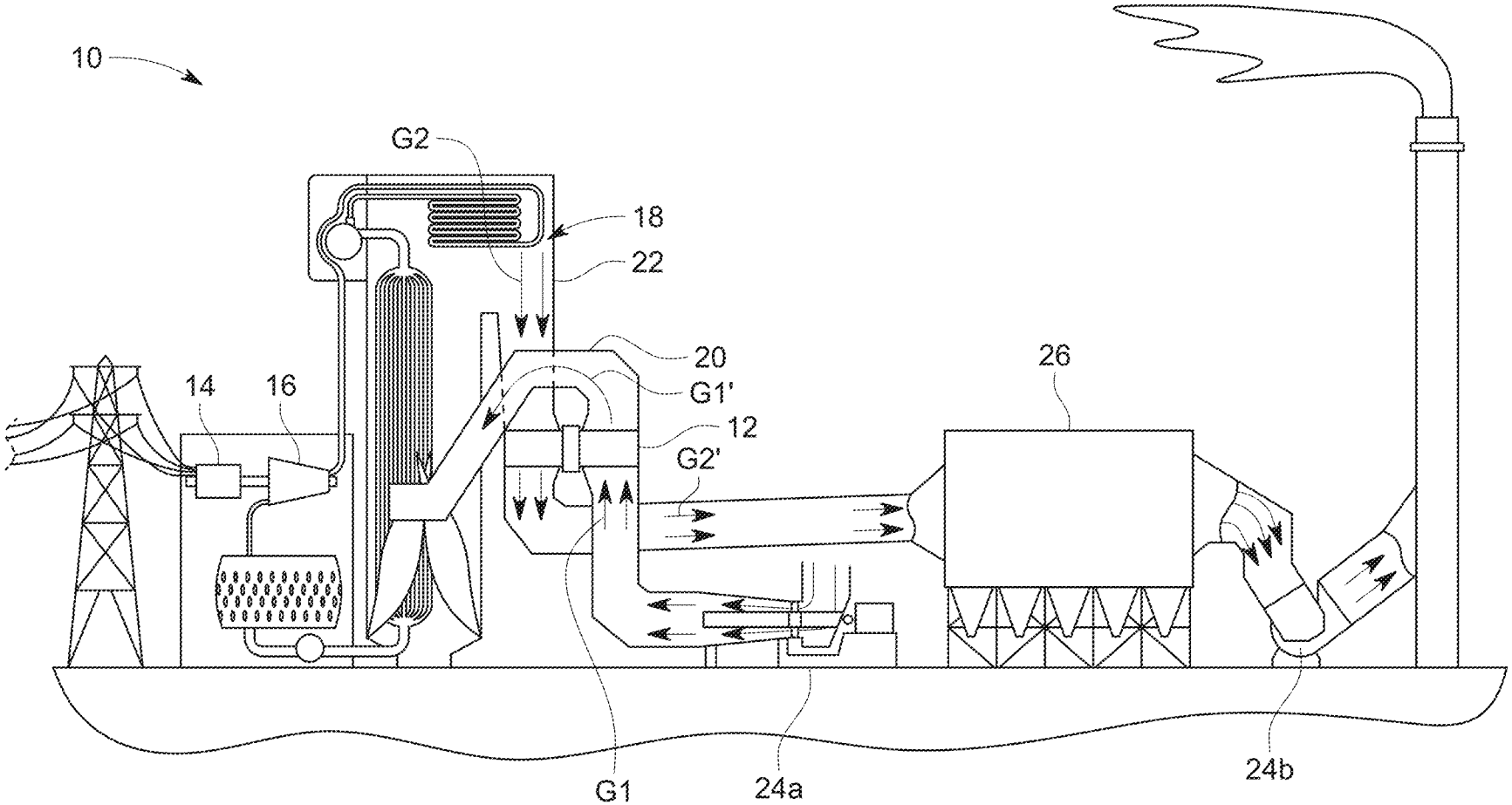
FIG. 1 is a schematic view of a power plant with a rotary heat exchanger that may utilize one or more of the sector plates presented herein, according to an example embodiment of the present invention.

The present inventive concept is best described through certain embodiments thereof, which are described in detail herein with reference to the accompanying drawings, wherein like reference numerals refer to like features throughout. It is to be understood that the term invention, when used herein, is intended to connote the inventive concept underlying the embodiments described below and not merely the embodiments themselves. It is to be understood further that the general inventive concept is not limited to the illustrative embodiments described below and the following descriptions should be read in such light.

Generally, this application is directed to a sector plate for a rotary heat exchanger and a method for designing the same. The sector plate may be a cost-effective and easily installable solution to reduce or minimize leakage (e.g., hot end radial seal leakage) in a rotary heat exchanger. As is explained below, the sector plate presented herein is self-supported during operations of the heat exchanger. Thus, the sector plate presented herein need not ride on a rotor or a housing of a rotary heat exchanger during operations of the heat exchanger. That is, the sector plate presented herein is not supported by rollers at its distal end and, thus, can be easily installed or retrofitted without modifying a rotor or housing of a rotary heat exchanger. Moreover, the sector plate presented herein may naturally deform in a parabolic shape in response to a downward actuation (and without an upward actuation). This may ensure the sector plate conforms to any rotor deformation (e.g., "rotor turndown") and minimizes a running gap between the sector plate and the one or more radial plates of the rotor.

An example power plant 10 of a type that may incorporate a rotary heat exchanger 12 with sector plates according to the present application is illustrated in FIG. 1. The power plant 10 includes a generator 14 coupled with a steam turbine 16 to produce electricity. The turbine 16 is driven by steam from a boiler 18, which receives preheated air G1' for combustion via an air intake 20 and expels combustion gases G2 via an exhaust 22. Fans 24*a* and 24*b* may be used to supply air G1 to the boiler intake 20 and to draw combustion gases G2 from the exhaust 22 through a particulate removal system 26 before it is released to the atmosphere. A rotary regenerative heat exchanger 12 may be positioned adjacent the boiler intake 20 and the exhaust 22 to heat the air G1 so that preheated air G1' enters the boiler 18. The air G1 is heated with heat from combustion gases G2 expelled from the boiler, which are cooled by this process so that cooled exhaust gas G2' enters the particulate removal system 26. Additionally, although not shown, rotary regenerative heat exchangers may also be used as gas-gas heaters for heat transfer within the plant's emissions reduction systems.

Figure 2A:
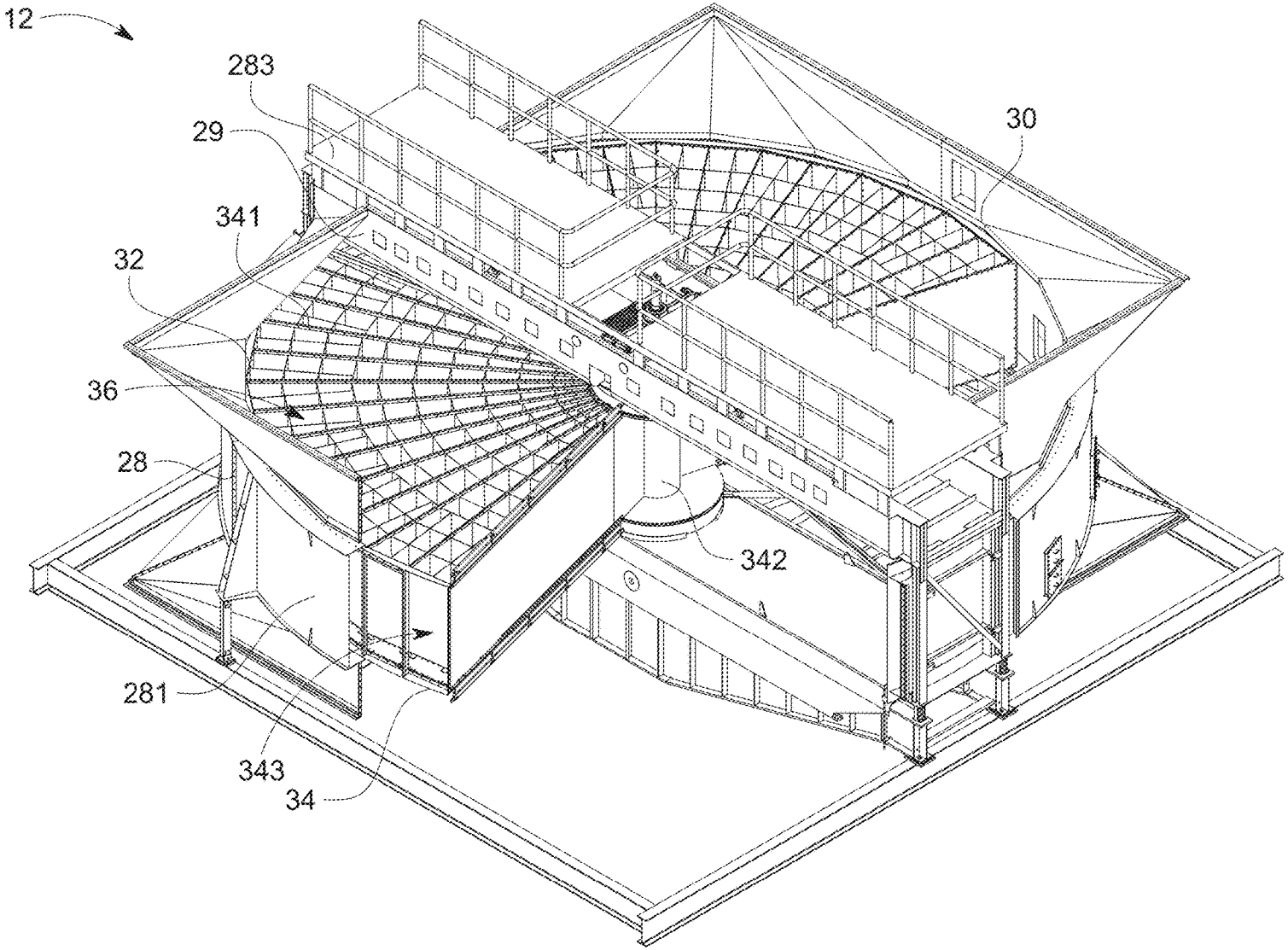
FIG. 2A is a partially cut-away perspective view of a rotary heat exchanger of a type that may use or include the sector plates presented herein, according to an example embodiment of the present invention.
Figure 2B:
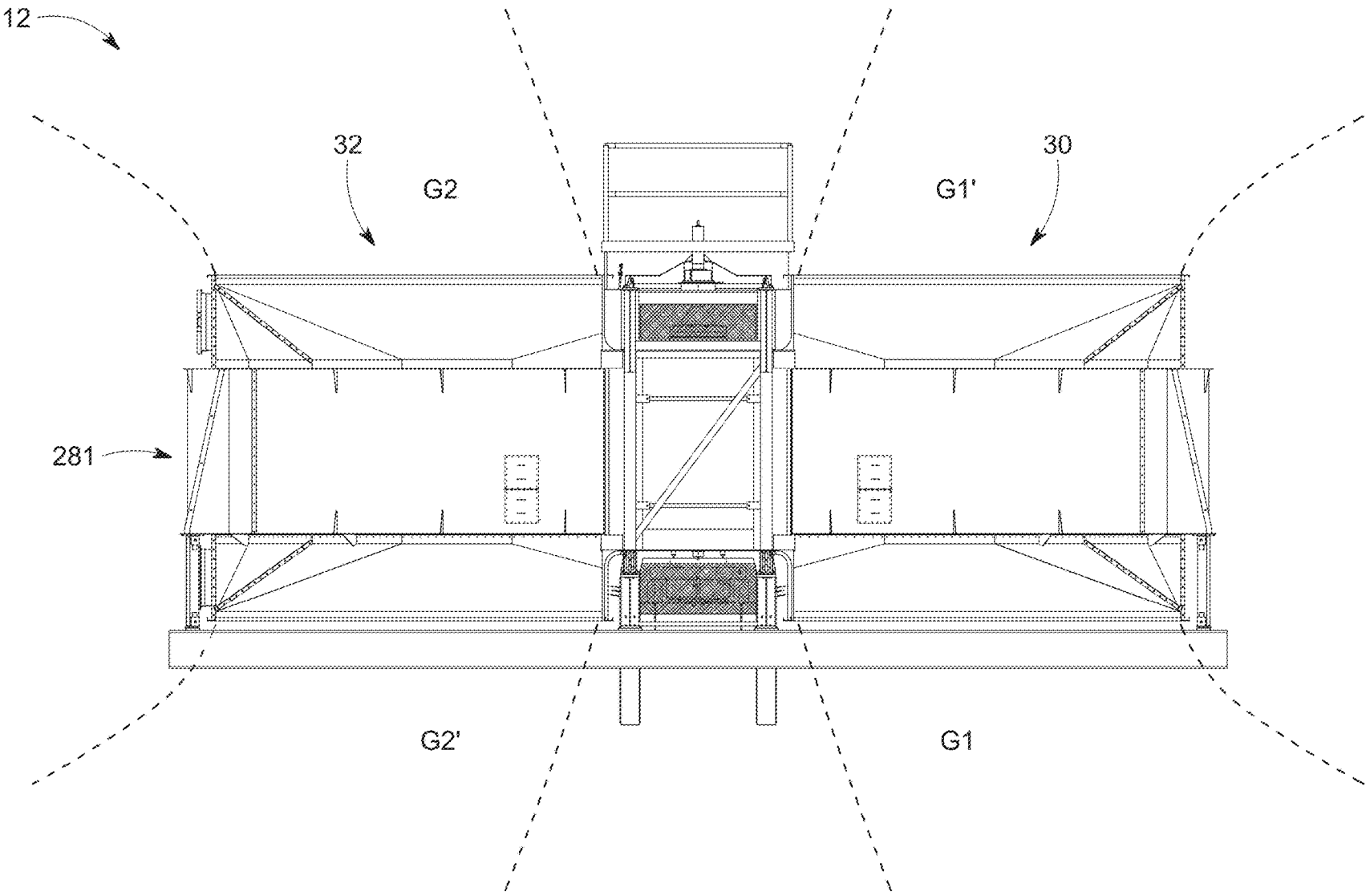
FIG. 2B is a side view of an exterior of the rotary heat exchanger of FIG. 2A.

FIGS. 2A and 2B provide a sectional view and a side view illustrating the rotary heat exchanger 12 preheating air G1 for the boiler 18 using heat from combustion gases G2 expelled from the boiler. The rotary heat exchanger 12 includes a housing 28 with a first duct or opening 30 and a second duct or opening 32. The first opening 30 communicates with the boiler air intake 20 (see FIG. 1) and the second opening 32 communicates with the boiler exhaust 22 (see FIG. 1). A rotor 34 containing a plurality of heat transfer element containers 36 is mounted for rotation in the housing 28. Specifically, the rotor 34 includes or is mounted on a rotor hub 342 that may be rotated by a motor to cause the rotor 34 to rotate through an annular space defined between the rotor hub 342 and a cylindrical section 281 of housing 28. A shell 343 of the rotor 34 is disposed adjacent to the cylindrical section 281 during this rotation.

During rotation of rotor 34, radial plates 341 of rotor 34 rotate through one or more sector assemblies that delineate different sectors within housing 28. In the depicted embodiment, sector assembly 29 separates the first duct 30 from the second duct 32. Thus, during rotation, the heat transfer element containers 36 in the rotor 34 move between ducts 30 and 32 by passing through sector assembly 29. The heat transfer elements in containers 36 are heated by exhaust gases G2 when aligned with the second opening 32 and transfer this heat to incoming air G1 when aligned with the first opening 30. This preheats the air G1 (e.g., from 30° C. to 340° C.) and also cools the temperature of exhaust gas G2

(e.g., from 370° C. to 125° C.). However, in other instances, one or more sector assemblies could delineate any number of sectors in the annular space between the rotor hub 342 and the cylindrical section 281 of housing 28 (e.g., for a tri-sector, quad-sector, etc. rotary heat exchanger). Moreover, in the depicted embodiment, the sector assembly 29 is supported, at least in part, by a lateral support member 283 that extends between the first duct 30 from the second duct 32, but in other embodiments, the housing 28 may include no supports or any other desirable supports.

Figure 3:
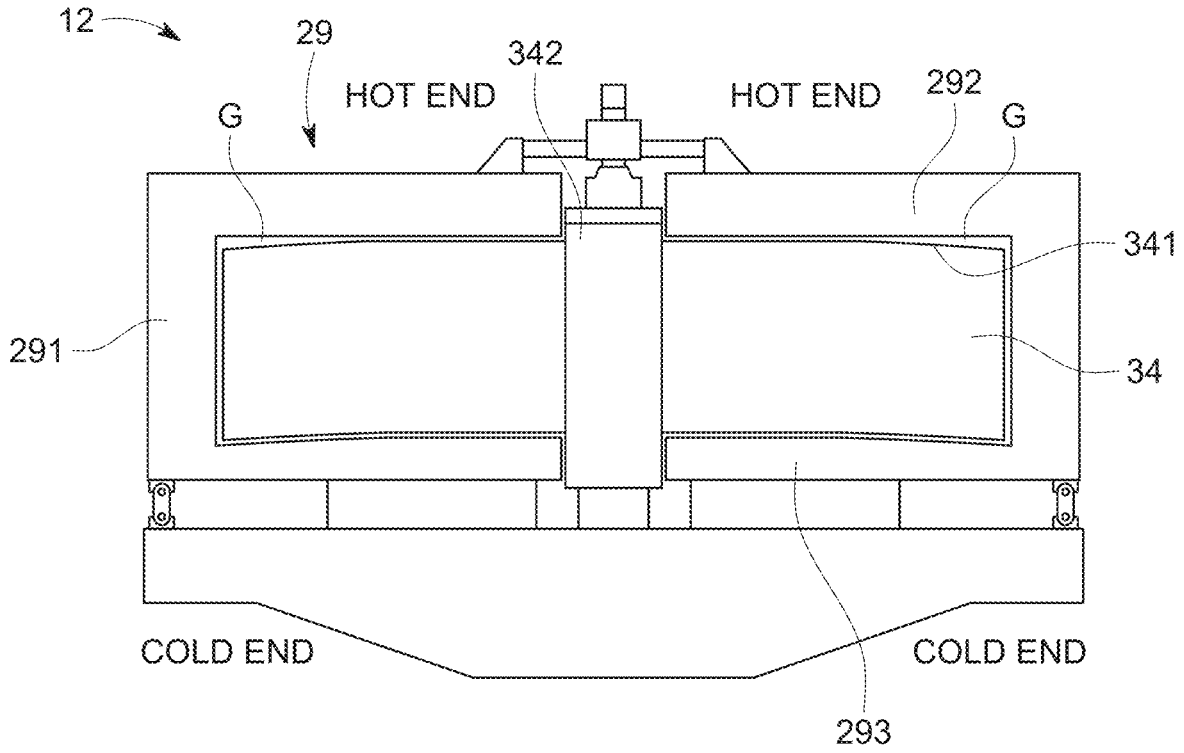
FIG. 3 (PRIOR ART)
FIG. 3 is a sectional view of a prior art rotary heat exchanger that does not include the sector plates presented herein, the prior art rotary heat exchanger illustrating rotor deformation that occurs during operation.

Now turning to FIG. 3, but with continued reference to FIGS. 2A and 2B, during operation of a rotary heat exchanger, opposite ends of the rotor (e.g., a top and bottom of rotor 34) are subjected to opposite temperature extremes. This subjects the rotor 34 to differential expansion that causes parabolic deformation towards cold temperatures, often referred to as "rotor turndown" (e.g., towards the bottom of the heat exchanger). Deformation of the rotor 34, particularly at the outermost ends, creates large running gaps G between the radial plates 341 of the rotor 34 and a top 292 of the sector assembly 29. These running gaps G allow for significant leakage between the hot and cold fluid passing through the rotary heat exchanger 12 (e.g., hot exhaust gas and cold ambient air), often referred to as radial seal leakage. In particular, the higher-pressure air G1 (in duct 30) can leak through the running gap G to the lower pressure hot flue gas G2 (in duct 32).

Figure 4:
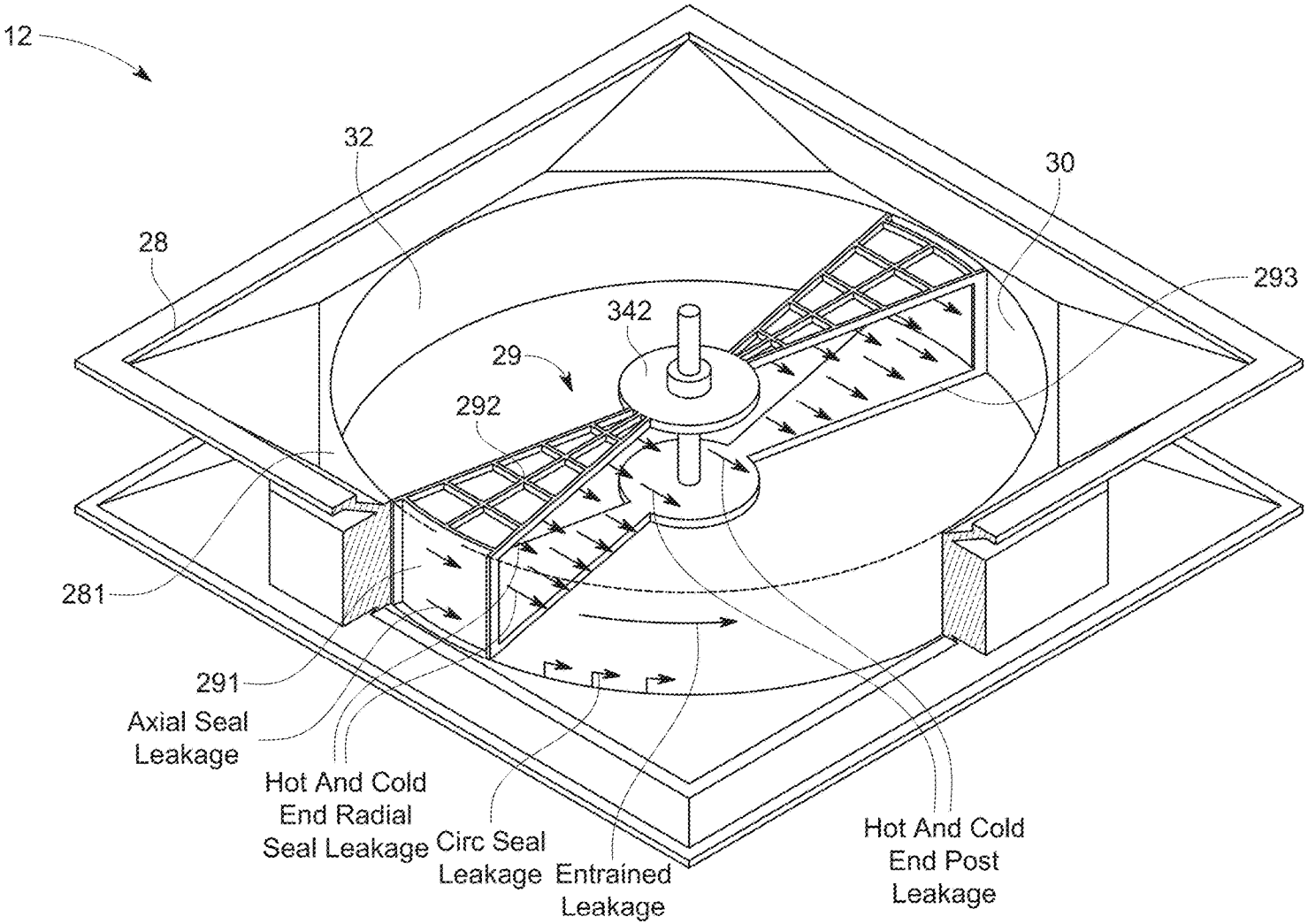
FIG. 4 (PRIOR ART)
FIG. 4 is a perspective of a prior art rotary heat exchanger that does not include the sector plates presented herein, the prior art rotary heat exchanger illustrating leakage within a rotary heat exchanger.

For clarity, FIG. 4 illustrates this radial seal leakage in combination with other common leakage issues associated with rotary heat exchangers. As mentioned, rotor turndown may allow for significant radial seal leakage between the rotor 34 and the top 292 of the sector assembly 29. Additionally or alternatively, rotor deformation may allow for radial seal leakage between the rotor 34 and a bottom 293 of the sector assembly 29 (e.g., between the bottom of the radial plates of the rotor 34 and a bottom sector plate). Radial seal leakage may be referred to as hot end radial seal leakage when the leakage is disposed on the side where combustion gas G2 enters the rotary heat exchanger (e.g., the inlet of duct 32), which is often the top of a rotary heat exchanger. Radial seal leakage may be referred to as cold end radial seal leakage when the leakage is disposed on the side where air G1 enters the rotary heat exchanger (e.g., the inlet of duct 30), which is often the bottom of a rotary heat exchanger. Otherwise, there may be axial seal leakage between the rotor 34 and the sides 291 of a sector assembly 29, circular seal leakage between the shell 343 of the rotor 34 and the cylindrical section 281 of the housing 28, and/or entrained leakage of the rotor 34.

Figure 5:
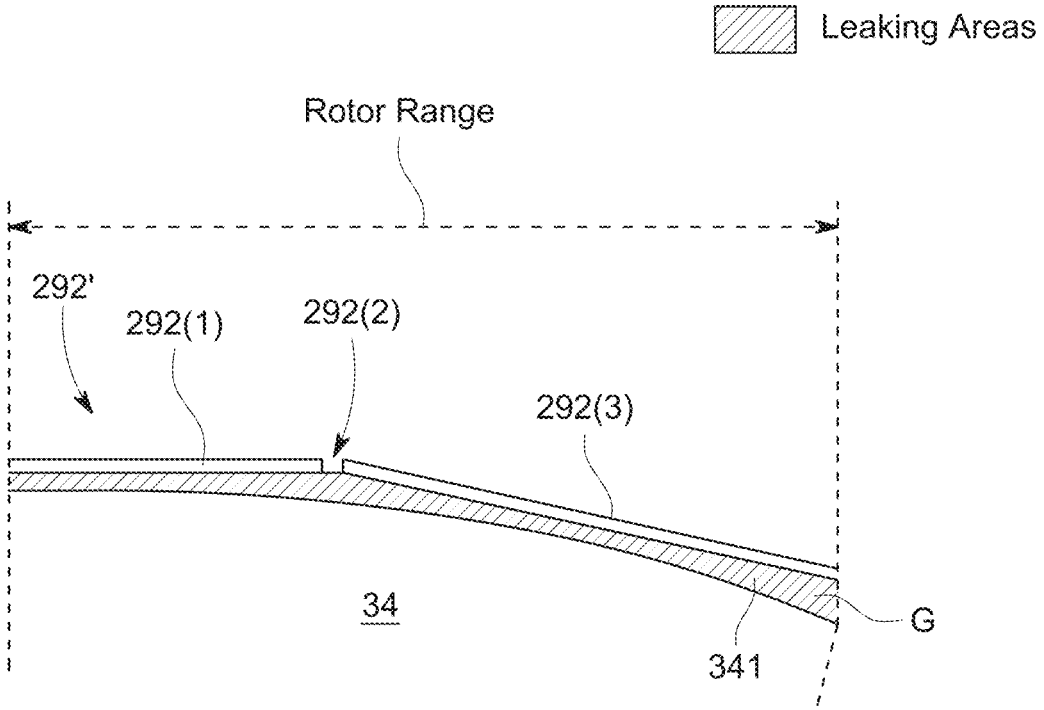
FIG. 5 (PRIOR ART)
FIG. 5 is a side, sectional view of a prior art sector plate attempting to minimize a running gap between the sector plate and a rotor.

FIG. 5 illustrates one known manner of addressing radial seal leakage. This known solution provides a hinged top sector plate 292'. The hinged sector plate 292' includes a fixed section 292(1) that is connected to a modulated section 292(3) via a hinge 292(2). This sector plate 292' can be connected to a control system with positional sensors (e.g., proximity sensors) and actuators that can pivot the modulated section 292(3) about hinge 292(2) based on detected positions. However, the reliance on positional sensors and complex control systems increases cost and the potential for error (e.g., since proximity sensors may malfunction in an rotary heat exchanger environment, which has high temperature fluctuations, particulate contamination, and other factors that are detrimental to positional sensors). Moreover, as can be seen, pivoting the two-part sector plate 292' around hinge 292(2) may not accurately conform the sector plate to parabolic deformation of rotor 34. Instead, the radial plates 341 may deform parabolically and the two-part sector plate 292' may bend linearly, causing the running gap G between the radial plates 341 and the sector plate 292' to diverge near the hinge 292(2) and at a distal end of the modulated section 292(3).

Although not shown, another way of addressing radial seal leakage is to hold the outermost ends of sector plates in compression against the rotor using springs so that the sector plates are self-modulating instead of modulated by a complex control system. China Utility Patent ZL201621086153.3 describes an example of this type of self-modulation. However, with such a design, contact rollers at the outermost ends of the sector plates run on the naturally deforming rotating rotor and require lubrication and/or cooling.

Now turning to FIGS. 6-9, the sector plate 400 presented herein is specifically designed to have a graduated stiffness (e.g., a variable moment of inertia along its length) that allows parabolic deformation of the sector plate 400 in response to a downward actuation force being applied to a distal end of the sector plate 400. The sector plate 400 may be included at a top or hot end of the rotary heat exchanger 12, a bottom or cold end of a rotary heat exchanger, or both. Regardless, the sector plate 400 is configured (e.g., shaped and sized) to be positioned across a radial dimension of the rotor 34 of the rotary heat exchanger 12 so that a bottom surface 430 can form one or more seals with one or more radial plates 341 of the rotor 34 during operation (e.g., rotation) of the rotor 34. That is, the sector plate 400 may be a sector of a circle defined by the rotor 34 and may allow for any sealing now known or developed hereafter, such as single sealing, double sealing, triple sealing, quadruple sealing, sextuple sealing, etc. Put still another way, a sector plate 400 may extend from the rotor hub 342 to the cylindrical section 281 of the heat exchanger housing 28 and may span any sector of that space.

In the embodiment depicted in FIGS. 6-9, the rotary heat exchanger 12 includes four sector plates 400, two at a top end (e.g., the hot end) of the rotary heat exchanger 12 and two at the bottom end (e.g., the cold end) of the rotary heat exchanger 12. Each pair of sector plates 400 extends in opposite directions from the rotor hub 342 to define a bi-sector heat exchanger with ducts 30, 32 of approximately equal sizes. However, this is merely an example and in other embodiments, sector plates 400 can be used to define any number of ducts of any size (e.g., as part of a tri-sector, quad-sector, etc. heat exchanger). Additionally, in other embodiments, sector plates 400 might only be included at only a top or only a bottom of a sector assembly 29 and known sector plates might be included at the other.

Moreover, in the depicted embodiment, the sector plates 400 are disposed substantially beneath lateral support members 283. In some embodiments, the sector plates 400 might be coupled to the lateral support members 283 adjacent the rotor hub 342; however, the sector plates 400 need not be coupled thereto. In fact, the sector plates 400 may not be coupled to or supported by any other components at their distal ends 436 (see FIG. 10). Instead, the sector plates 400 are designed to support their own weight, at least during operations of a rotary heat exchanger in which they are included. As such, rollers, bearings, as well as the coolant/lubrication systems and other such components associated therewith, are not required for sector plates 400. However, although not shown, in at least some embodiments, the sector plates 400 may also be pushed or lifted upwards prior to starting a rotary exchanger to ensure the sector plates do not rub against or interfere with a rotor 34 during start-up. During operation, there is no need to provide this upward push (and the sector plate 400 naturally deforms parabolically in response to only a downward actuation). That said, the sector plates 400 generally deform away from lateral support members 283, towards the rotor 34.

Figure 6:
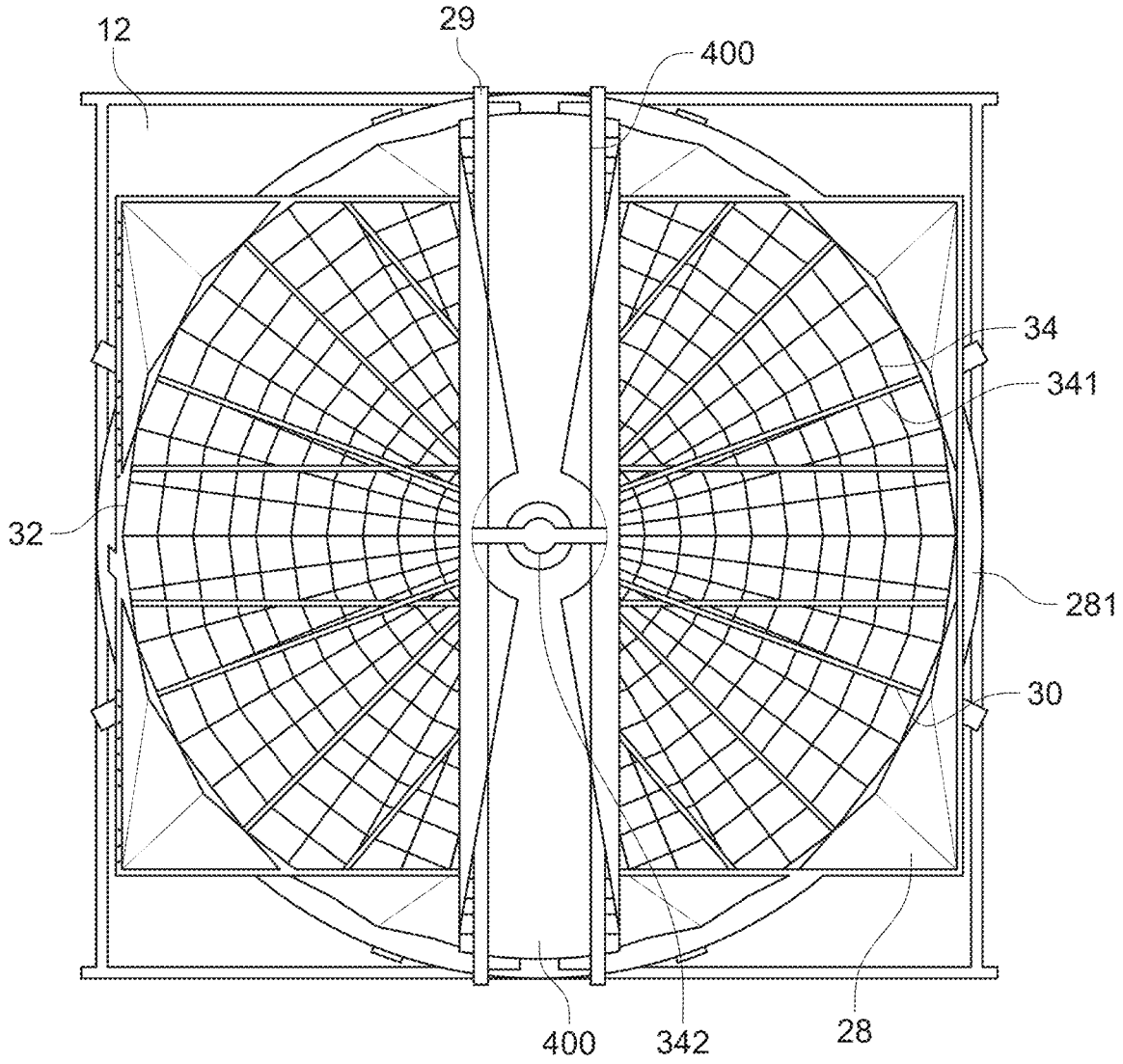
FIG. 6 is a top, sectional view of a rotary heat exchanger including two sector plates formed in accordance with an example embodiment presented herein.
Figure 7A:
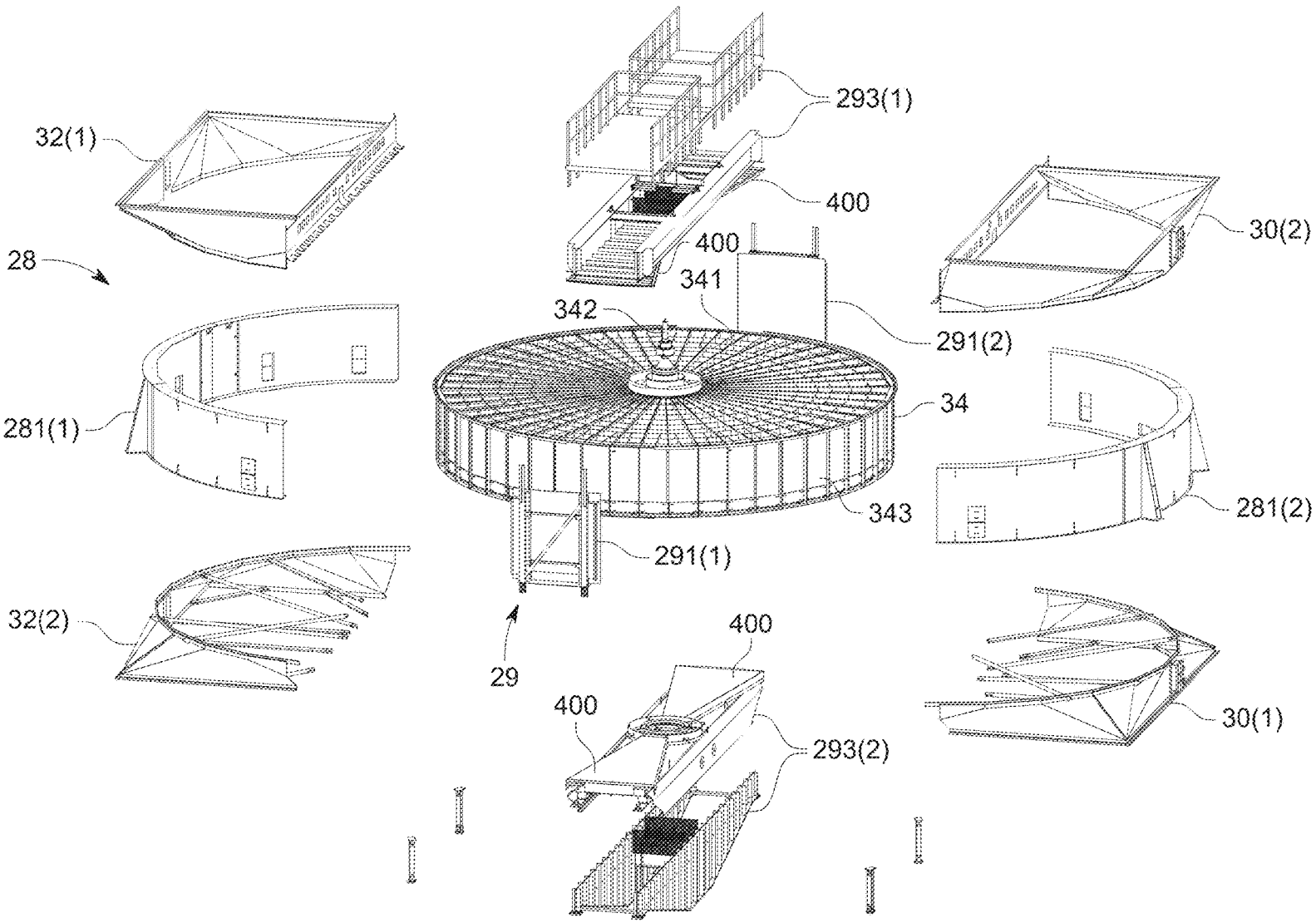
FIG. 7A is an exploded view of the rotary heat exchanger of FIG. 6.
Figure 7B:
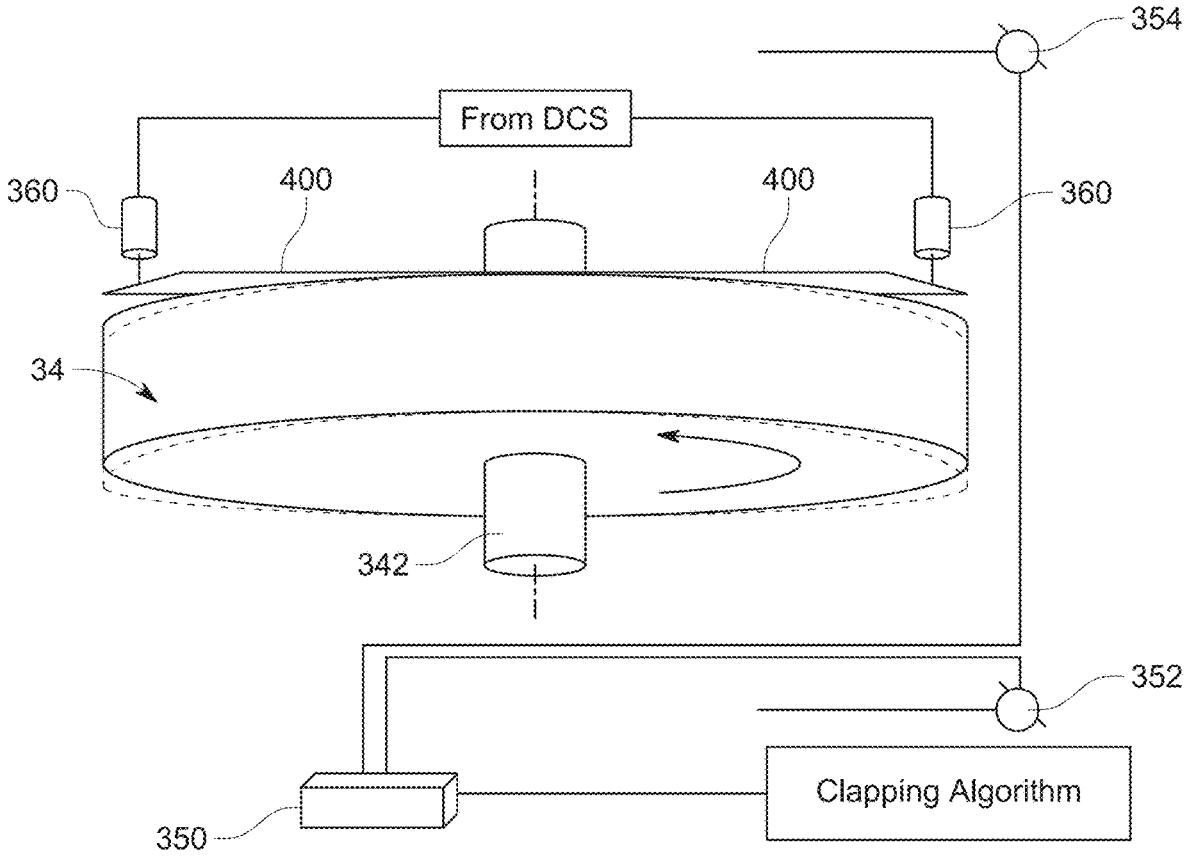
FIG. 7B is a high-level schematic diagram of a portion of the rotary heat exchanger of FIG. 6.

Now turning specifically to FIG. 7B, although not clearly shown in FIGS. 6 and 7A, the rotary heat exchanger 12 may include one or more actuators 360 per sector plate 400 (FIG. 7B depicts one actuator 360 per sector plate 400, but this is merely an example). The actuators 360 may be controlled by a processor 350 that determines an amperage of current to send to the actuators 360 based on temperature readings from a cold end temperature sensor 352, a hot end temperature sensor 354, and a capping algorithm that correlates the temperature readings to current values based on properties (e.g., stiffness) of the sector plate 400, which are determined and/or achieved in accordance with the methods described in detail below.

Generally, actuators 360 may comprise any actuator(s) now known or developed hereafter, such as linear electrical actuators. However, the actuators 360 may only apply a downward force on the sector plate 400 during operations of the heat exchanger 12. That is, in at least some embodiments, the actuators 360 do not support or hold the sector plate 400 and either push downwards to initiate a deformation or remove a downward force (e.g., retract a pin) to end or reduce a parabolic deformation. Meanwhile, temperature sensors 352 and 354 may comprise any temperature sensor now known or developed hereafter, including pre-existing temperature sensors included in duct 30 and/or duct 32 (see FIG. 2A), and the processor 350 may be or include any number of processing cores, each of which may can perform processing separately.

Additionally or alternatively, processor 350 may include special purpose logic devices (i.e., application specific integrated circuits (ASICs)) or configurable logic devices (i.e., simple programmable logic devices (SPLDs), complex programmable logic devices (CPLDs), and field programmable gate arrays (FPGAs)), that, in addition to microprocessors and digital signal processors may individually, or collectively, are types of processing circuitry. Generally, the processor 350 performs a portion or all of the processing steps required to execute received instructions and/or instructions contained in an associated memory.

Figure 8:
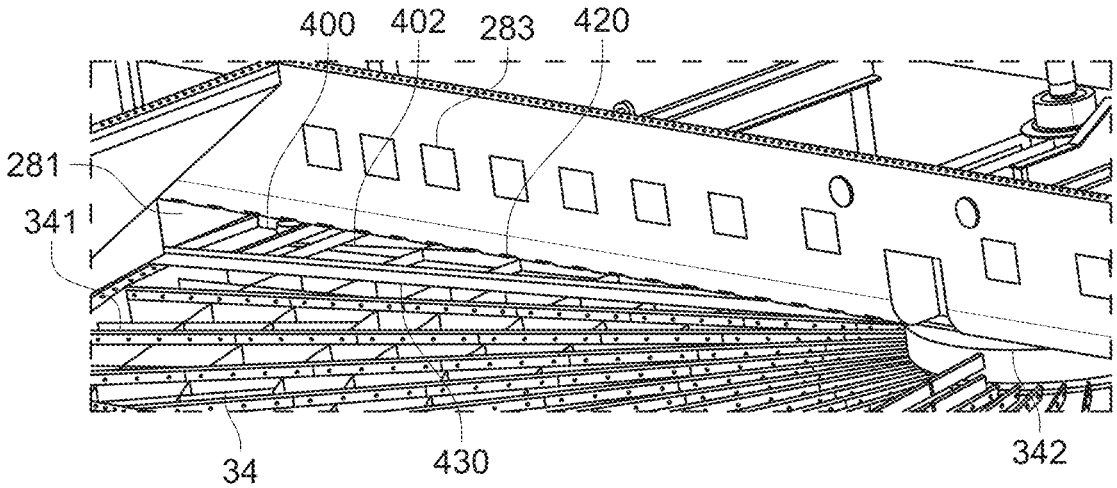
FIGS. 8 and 9 are perspective views of portions of the rotary heat exchanger of FIG. 6, the perspective views showing one of the sector plates.
Figure 9:
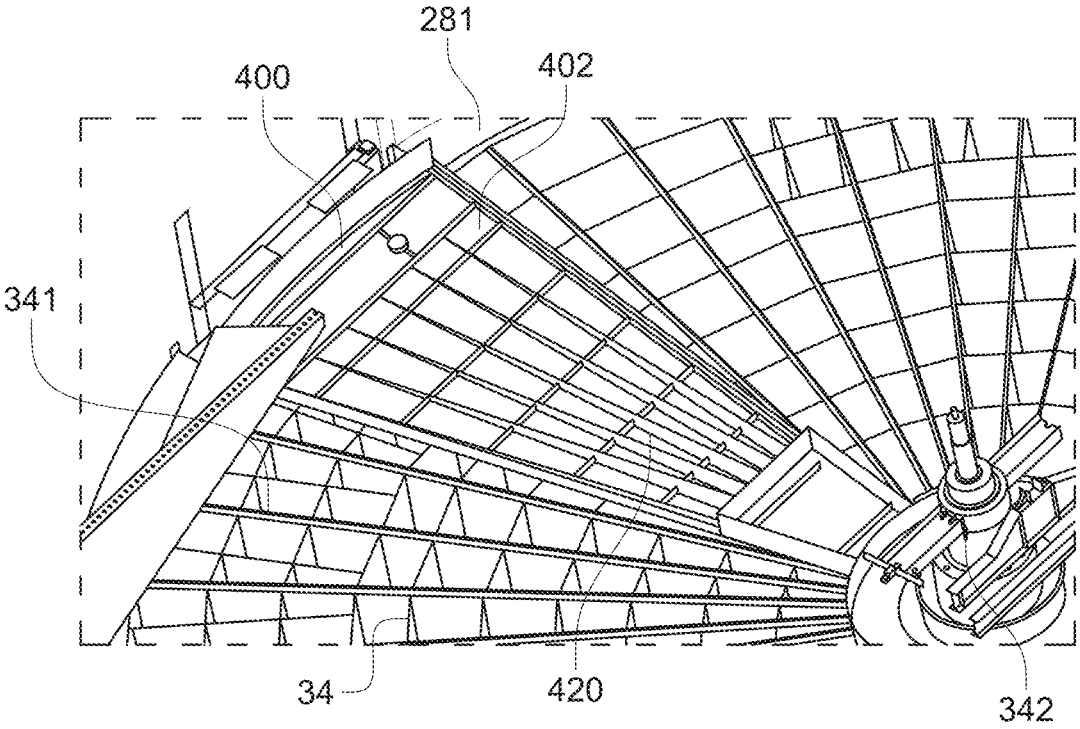

As can be seen in FIGS. 8 and 9, the sector plates 400 include a plurality of tapered ribs 420 that taper (e.g., narrow) from the rotor hub 342 towards the cylindrical section 281 of the housing 28. These ribs 420 provide the sector plates 400 with graduated stiffness (e.g., a moment of inertia that varies along the radial dimension (i.e., the length) of the sector plate 400) that causes parabolic deformation towards the rotor 34. The ribs 420 are included on a top surface 402 of the sector plates 400, while a bottom surface 430 of the sector plates 40 is substantially flat (see FIG. 11) so that it can form one or more seals with one or more radial plates 341 of the rotor 34.

Figure 10:
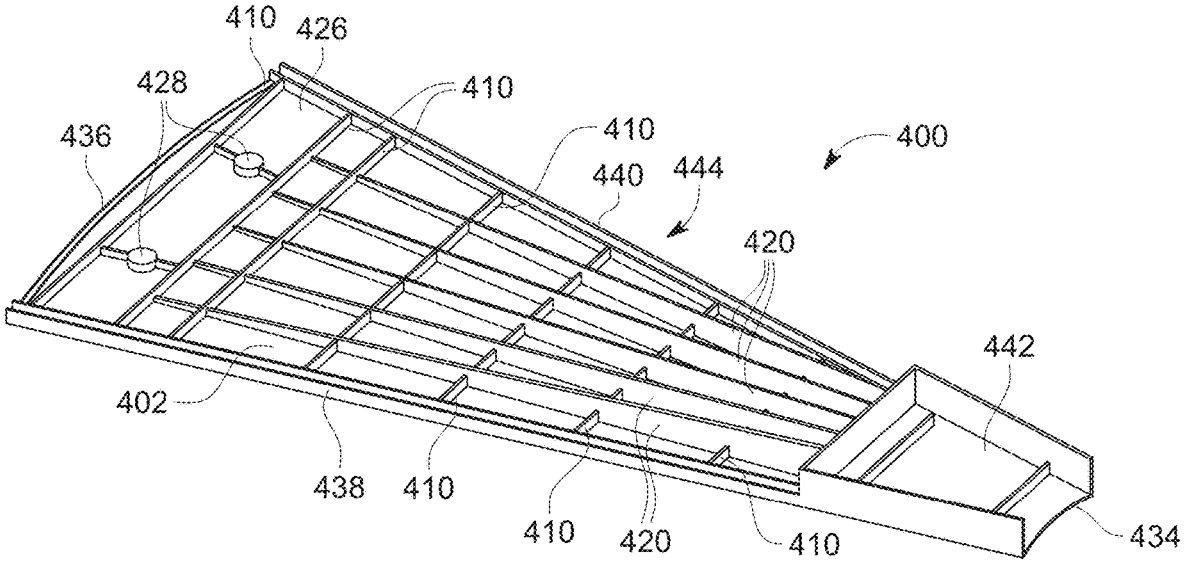
FIGS. 10 and 11 are top and bottom perspective views, respectively, of the sector plate of FIGS. 8 and 9.
Figure 11:
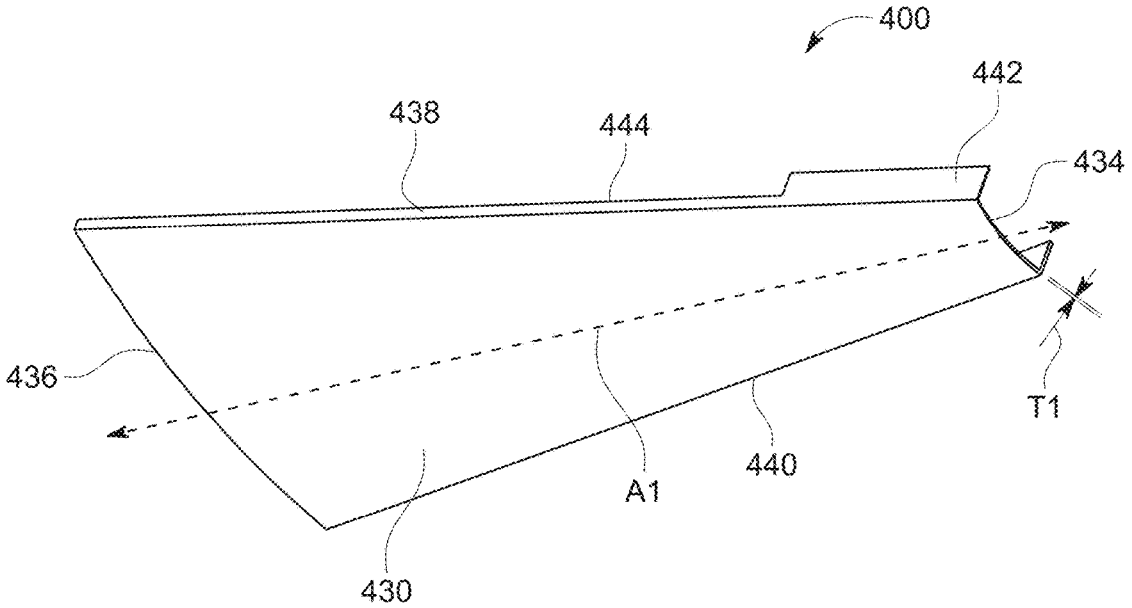

More specifically, and now turning to FIGS. 10 and 11, the sector plate 400 extends from a first end 434 to a second end 436. The first end 434 engages and/or is coupled to the rotor hub 342 while the second end 436 is disposed adjacent the shell 343 of the rotor 34 and/or the cylindrical section 281 of the rotary heat exchanger housing 28. Additionally, the sector plate 400 extends from a first edge 438 to a second edge 440. The first edge 438 and second edge 440 are angled outward with respect to the first end 434 so that the sector plate 400 defines a sector of a circle (e.g., the circle defined by the rotor 34). In at least some embodiments, the first edge 438 and the second edge 440 are angled at the same angle with respect to a longitudinal axis A1 of the sector plate 400, which bisects the first end 434 and the second end 436.

Collectively, the first edge 438, the second edge 440, the first end 434, and second end 436 define the top surface 402 and the bottom surface 430. As is illustrated in FIG. 11, edges 438 and 440 also define a thickness T1 between the top surface 402 and the bottom surface 430. In the depicted embodiment, the thickness T1 is constant; however, in other embodiments, the thickness T1 could vary from edge 438 to edge 440 and/or from first end 434 to second end 436. Regardless, the bottom surface 430 may be substantially smooth (e.g., flat) so that the bottom surface 430 can form one or more seals with one or more radial plates 341 of the rotor 34 (the bottom surface 430 could also include any desired shapes or structures, such as overlapping panels, to facilitate seal formation). Meanwhile, the top surface 402 includes lateral ribs 410 that extend transversely across a width of the top surface 402 and tapered ribs 420 that extend radially along a length of the top surface 402.

In particular, the lateral ribs 410 extend from the first edge 438 to the second edge 440 to define a number of longitudinal sections 423 along a length of the top surface 402 (e.g., moving along axis A1 from the first end 434 to the second end 436). As an example, in the embodiment depicted in FIG. 14, six lateral ribs 410(1)-410(6) define seven sections 423(1)-423(7) between the fixed section 442 and the second end 436. However, the last section 423(7), which is a small curved section is defined beyond the last lateral rib 410(6), may be considered an end of the sector plate 400 instead of a sector so that the sector plate 400 may also be described as having six sections. In different embodiments, the number of sections 423 included in a sector plate 400 may vary based on the size and/or sealing to be provided. For example, a double sealing sector plate 400 may only include three or four lateral ribs 410 while the depicted embodiment may be suitable for triple sealing. The number of sections 423 may also depend on a material used to form the sector plate, since the material and size of the sector plate 400 may determine the weight of the sector plate 400 (and the sector plate is self-supporting).

By comparison, the tapered ribs 420 extend through the longitudinal sections 423, decreasing in height towards the second end 436. In fact, in the depicted embodiment, the tapered ribs 420 terminate prior to a final longitudinal section 423(6), which is referred to herein as an actuation section 426. However, in other embodiments, the tapered ribs 420, or at least a portion of the tapered ribs 420, may extend into the actuation section 426. Either way, the actuation section 426 may include actuation points 428 on which actuators 360 can act to deform the sector plate 400. In the depicted embodiment, the sector plate 400 includes two actuation points 428; however, in other embodiments, the sector plate 400 may include any number of actuation points 428.

Figure 14:
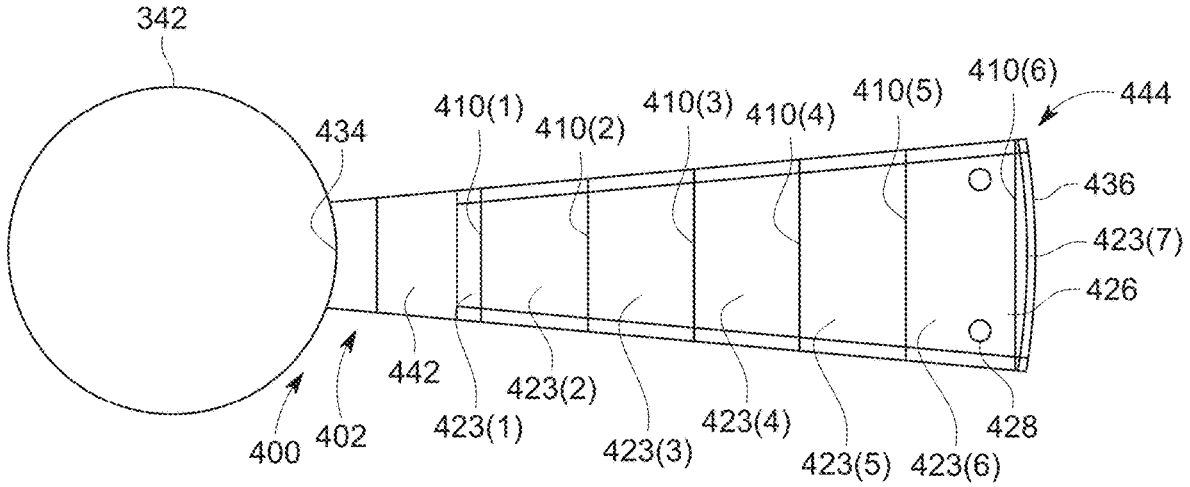
FIG. 14 is a top plan view of the sector plate of FIGS. 8 and 9 with the tapered ribs removed.
Figure 15A:
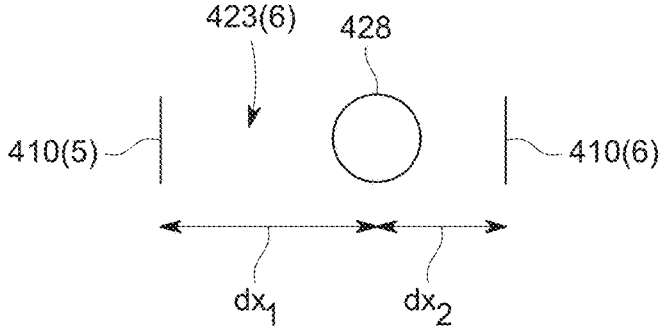
FIGS. 15A and 15B are diagrams illustrating the placement of a lateral rib included on the sector plate of FIGS. 8 and 9.
Figure 15B:
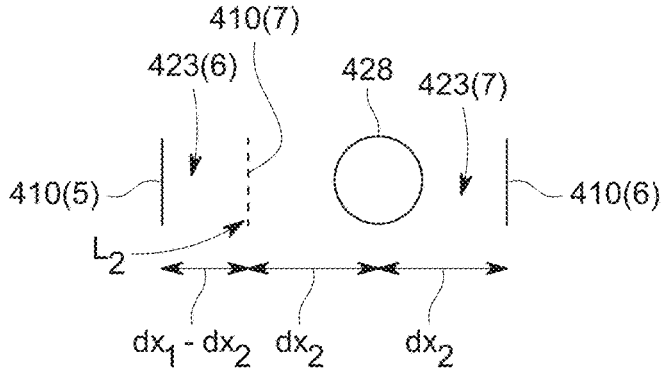

In fact, and now turning briefly to FIGS. 14, 15A, and 15B, in order to ensure the actuation section 426 is stable, the actuation section 426 section may be bounded by lateral ribs 410 that are equally spaced from the one or more actuation points 428. As is shown in FIGS. 14 and 15A, initially the lateral ribs 410 may be placed to support the tapered ribs 420 and the overall weight of the sector plate 400. The placement of the lateral ribs 410 may also be based on the size of the sector plate 400 and the desired sealing to be provided by the sector plate 400. Then, the distances between the actuation points 428 and the nearest lateral ribs 410 may be measured as $d_{x1}$ and $d_{x2}$ and an extra lateral rib 410 may be added in the larger space to provide lateral ribs 410 that are equidistant from the one or more actuation points 428.

For example, in the embodiment depicted in FIGS. 14, 15A, and 15B, the extra lateral rib, which is the seventh rib 410(7), may be added into the larger space between $d_{x1}$ and $d_{x2}$, but spaced equidistant to the actuation points 428 as the smaller space between $d_{x1}$ and $d_{x2}$. Specifically, in the depicted embodiment, the seventh rib 410(7) is added in the space spanned by $d_{x1}$, but is spaced a distance $d_{x2}$ from the one or more actuation points 428. This ensures that the sector plate can stably receive an actuation force from one or more actuators 360 acting on the one or more actuation points 428 (and does deform unwantedly in this sector). Actuators 360 may act on the one or more actuation points 428 included in an actuation section 426 of the sector plate 400. As mentioned, the actuation force generated by actuators 360 may be based on a measured temperature differential in the rotary regenerative heat exchanger 12.

Moreover, either in addition to or as an alternative to being spaced from transverse ribs 410, the actuation points 428 can be equally spaced from the first edge 438 and the second edge 440 of the sector plate. That is, if a first actuation point 428 is spaced a distance X from first edge 438, a second actuation point may be spaced the distance X from the second edge 440. In the depicted embodiment, the actuation points 428 are shown laterally aligned (e.g., disposed on a single transverse axis); however, the actuation points 428 can also be arranged on an arc or within an annular section (e.g., a section defined by concentric arcs) of the top surface 402 of the sector plate 400. Regardless, since the actuation points 428 and/or the actuation section 426 span a single section of the sector plate 400, a single actuator or actuator assembly (e.g., actuator 360) can actuate the sector plate 400. In fact, the sector plate 400 is designed to deform parabolically in response to an actuation at a single radial location, insofar as "single radial location" may denote a single lateral axis extending across the sector plate 400, a single arc extending across the sector plate 400, or an annular section (e.g., a section defined by concentric arcs) extending across the sector plate 400.

Now turning back to FIGS. 10 and 11, in the depicted embodiment, the root ends 421 of the tapered ribs 420 do not begin at the first end 434 of the sector plate 400. Instead, the sector plate 400 includes a fixed section 442 that extends radially outward from the first end 434 and a cantilevered section 444 that begins from an end of the fixed section 442. The tapered ribs 420 begin at the proximal end of the cantilevered section 444 (e.g., at the distal end of the fixed section 442). Notably, in a rotary regenerative heat exchanger 12, the rotor 34 may not deform immediately adjacent the rotor hub 342 (or may only deform a minimal amount). Thus, the sector plate 400 can be fixed or nearly fixed in an area adjacent the rotor hub 342 (the area of fixed section 442) and need not include tapered ribs 420 in this section.

Thus, the tapered ribs 420 are positioned radially exterior of the fixed section 442. In the depicted embodiment, the fixed section 442 extends approximately one-third of the sector plate radius (e.g., one-third the length of axis A1, which is also one-third of a rotor radius). Consequently, the cantilevered section 444 extends approximately two-thirds of the sector plate radius (e.g., two-thirds the length of axis A1). However, in other embodiments, the fixed section 442 may extend any radial distance (with the cantilevered section 444 extending the remainder of the sector plate radius) and the tapered ribs 420 can begin at any location on the top surface 402. In fact, in some embodiments, the sector plate 400 need not include a fixed section 442 and the cantilevered section 444 can extend the entire sector plate radius (so that the tapered ribs 420 begin the first end 434).

Figure 12A:
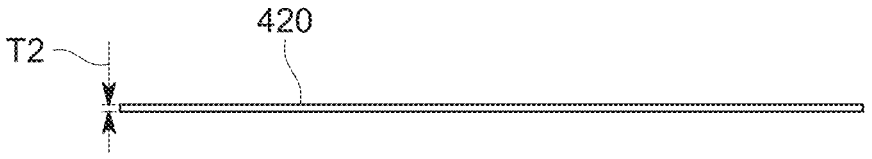
FIG. 12A is a top plan view of a tapered rib included on the sector plate of FIGS. 10 and 11.
Figure 12B:
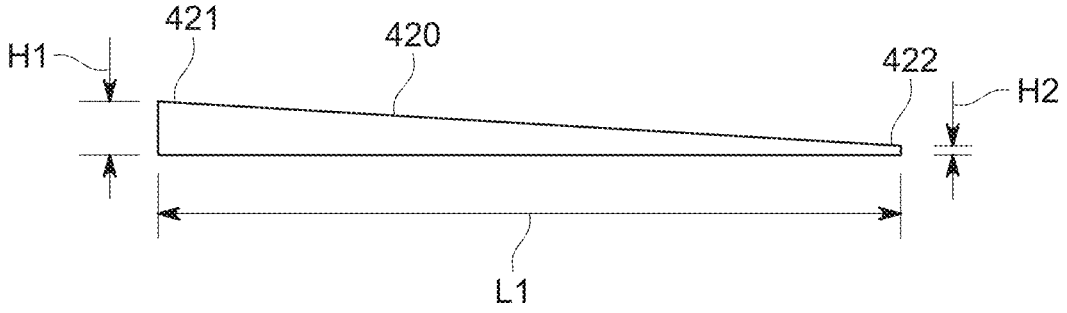
FIG. 12B is a side view of the tapered rib of FIG. 12A.

FIG. 12A illustrates a tapered rib 420 from a top plan view and FIG. 12B illustrates a tapered rib 420 from a side view. As can be seen, in the depicted embodiment, the tapered ribs 420 are right triangles with a constant thickness T2. The tapered ribs 420 taper from a root end 421 with a height H1 to a tail end 422 with a height H2. The tail height H2 may be equal to or smaller than a height of the lateral ribs 410 so that the tapered ribs 420 can terminate smoothly at a lateral ribs 410. Meanwhile, the root height H1 may be determined based on the specific configuration of a rotary regenerative heat exchanger 12 on which the sector plate 400 is to be installed, as is explained in further detail below. The tail height H2 may also be relatively constant across different embodiments, so the root height H1 may be determinative of the slope of the tapered ribs 420, in at least some embodiments. That said, in other embodiments, the tapered ribs 420 need not be a right triangle and can be any shape, including a circle segment, an irregular shape, or some combination thereof. Additionally, in some embodiments, the tapered ribs 420 might taper in height and width.

Generally, the tapered ribs 420 are sized to cause the sector plate 400 to parabolically deform to an actuated position in response to a downward actuation load being applied to the actuation points 428. In particular, the variable height of the tapered ribs 420 and the required actuator load are calculated, with scripting programs and/or three-dimensional models, to ensure that the parabolic shape of the sector plate 400 can match parabolic deformation of a rotor 34. However, the tapered ribs 420 are also designed to ensure that the sector plate 400 has sufficient stiffness and/or resiliency to return to a rest position in response to removal of the actuation load. Consequently, actuators 360 acting on the sector plate 400 can act in a single direction (e.g., downwards) to control deformation and the sector plate may control a return from deformation. That said, the sector plate 400 may naturally sag when in its rest position due to the weight of the sector plate 400. This sag is accounted for during design of the tapered ribs 420, as is explained in further detail below.

Figure 13:
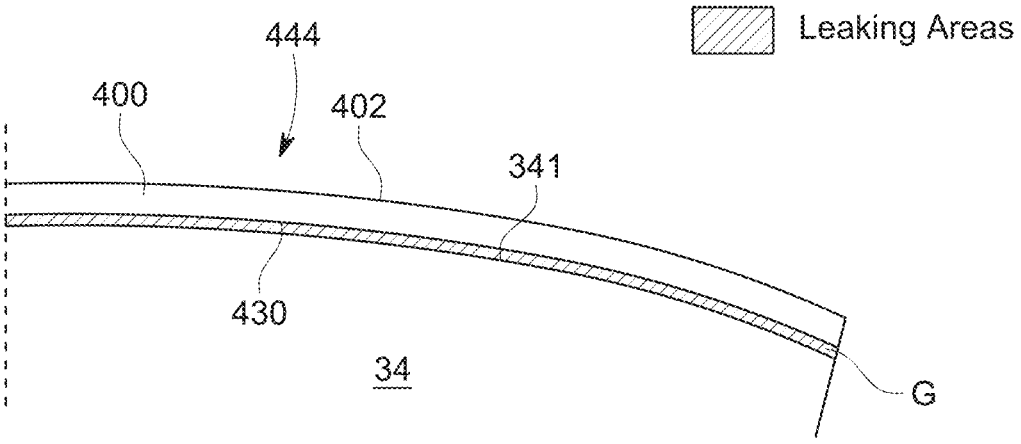
FIG. 13 is a side, sectional view of the sector plate of FIGS. 8 and 9 while in an actuated position.

FIG. 13 illustrates the parabolic deformation caused by the tapered ribs 420. That is, FIG. 13 illustrates the cantilevered section 444 while in an actuated position. As can be seen, when the cantilevered section 444 is actuated (by one or more actuators 360 acting on the one or more actuation points 428), it deforms parabolically to substantially match deformation of the rotor 34 caused by differential expansion. Since the sector plate 400 is designed to parabolically deform in response to actuation forces, the actuator 360 need not be part of a complicated control system. Instead, the actuator 360 can be controlled based on only a measured temperature differential and the design of the sector plate 400 will cause it to parabolically deform to match rotor deformation for that temperature differential. That said, in different embodiments, the actuators 360 could be actuated in any manner now known or developed hereafter, including in response to feedback from one or more sensors of any type (e.g., proximity, positional, etc.).

Regardless of how the actuators 360 are actuated, the running gap G between the bottom surface 430 of the sector plate 400 and the radial plates 341 of the rotor 34 is consistent and small even with a relatively simple actuation (e.g., only a downward actuation). Put another way, there are no, or at least a minimal amount of, diverging areas where leakage can increase (e.g., as are included in FIG. 5). For example, the running gap G may have a consistent height of 1/64 inches, 1/4 inches, or some measurement there between, such as 1/6 inches. Alternatively, the running gap G may vary slightly, but have a maximum height of 1/64 inches, a maximum height of 1/4 inches, or a maximum height between 1/64 inches and 1/4 inches, such as 1/6 inches. As is explained in further detail below, running gaps of this height may enable contact seals to be used with the sector plate 400 presented herein, which may significantly decrease radial seal leakage through a sector assembly.

Still further, the tapered ribs 420 are also designed so that the sector plate 400 can, during operations of the heat exchanger, support its own weight in a cantilevered fashion in its actuated position and its rest position. That is, the tapered ribs 420 are designed to ensure that the sector plate 400 need not be supported at its distal end 436. Instead, the overall stiffness of the sector plate 400, which is generated and/or controlled by dimensions of the tapered ribs 420, supports the weight of the sector plate 400. In fact, as mentioned, the stiffness/resiliency of the sector plate 400 may cause the sector plate 400 to be naturally biased to its rest position so that the sector plate 400 returns to its rest position in response to a removal of an actuation force. Since the tapered ribs 420 control this stiffness/resiliency, the tapered ribs 420 are described herein as causing the sector plate 400 to return to a rest position in response to removal of an actuation force.

Figure 16:
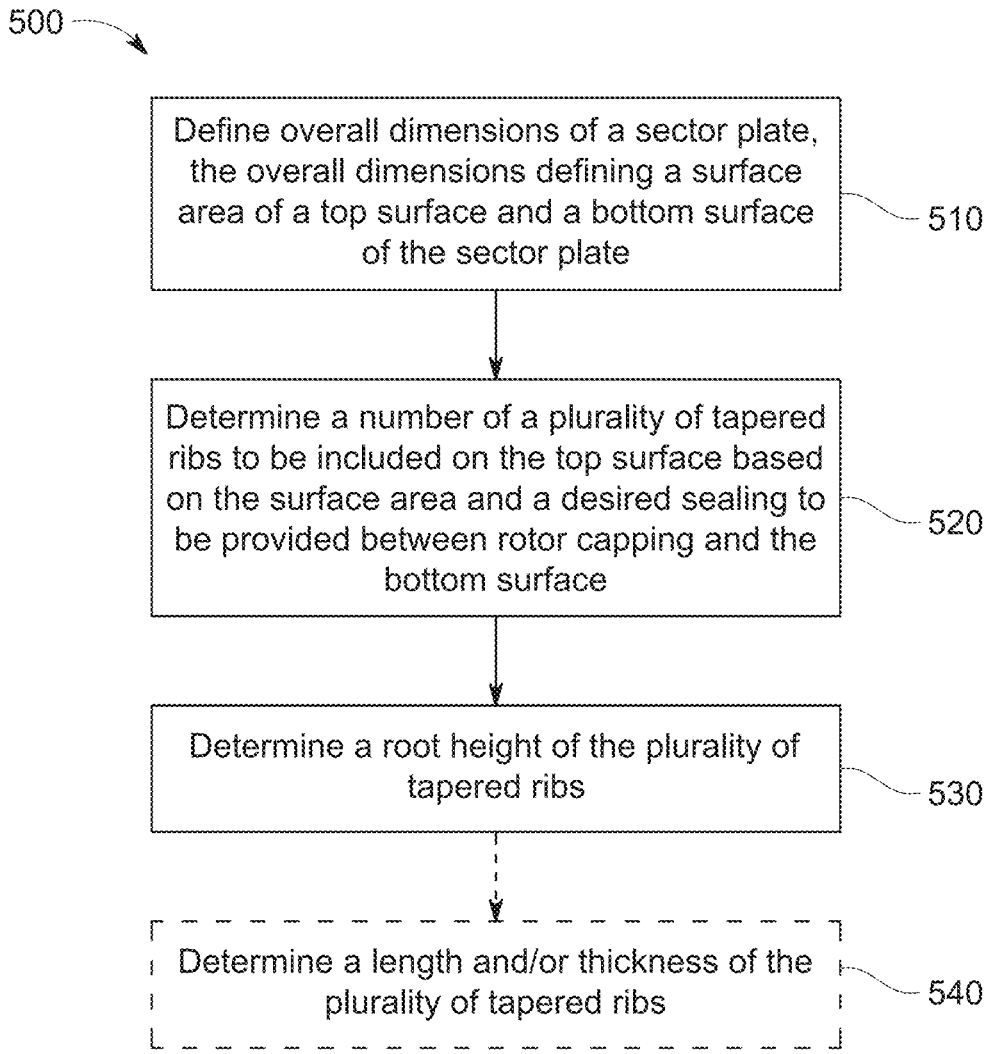
FIG. 16 is a high-level flow chart depicting a method for designing a sector plate, according to an example embodiment presented herein.
Figure 17:
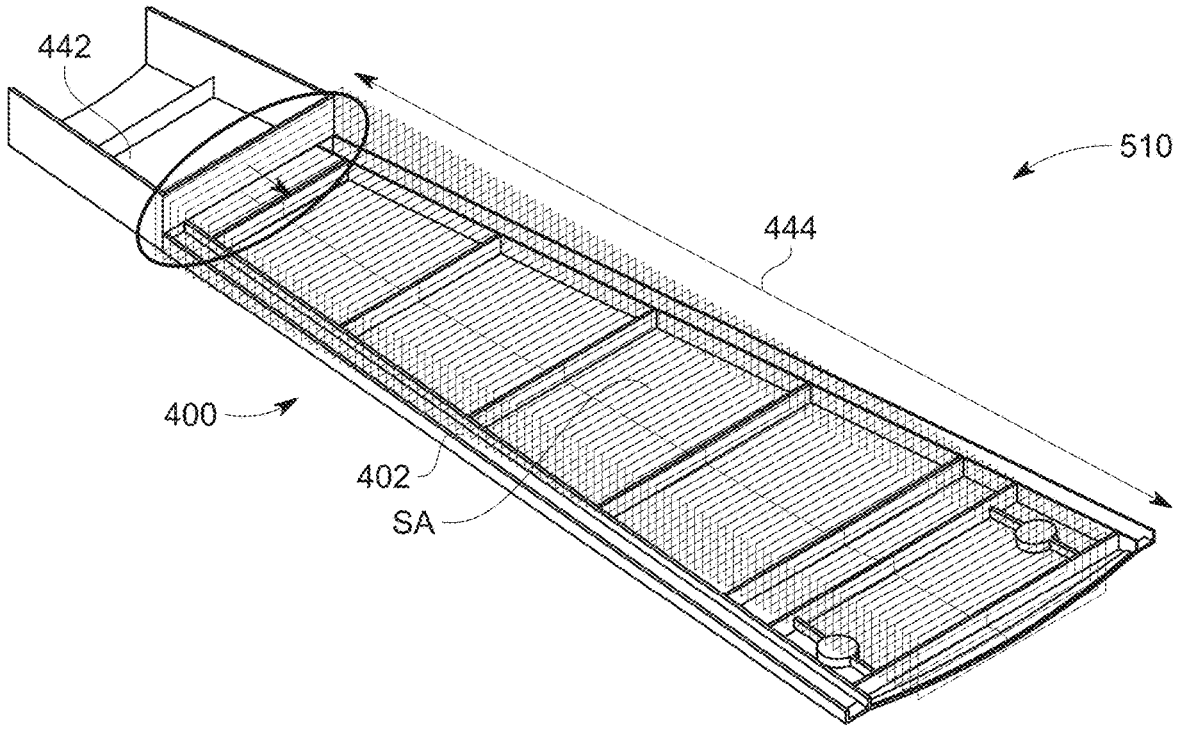
FIGS. 17 and 18 are diagrams pictorially illustrating steps, or portions of the steps, of the method of FIG. 16.

Now turning to FIG. 16, but in combination with FIGS. 10-15B, 17, and 18, the configuration of the sector plate 400, and in particular the number, size, and positions of the lateral ribs 410 and/or the tapered ribs 420, may be determined with one or more algorithms, as is generally depicted by method 500. Initially, at step 510, the overall dimensions of a sector plate are defined. The overall dimensions may include a radial length of the sector plate 400 (e.g., the length of axis A1) as well as a radial span of the sector plate 400 (e.g., the angle with which first edge 438 and second edge 440 extend with respect to axis A1). Thus, the overall dimensions may define a surface area SA of a top surface 402 and a bottom surface 430 of the sector plate, as illustrated in FIG. 17. The overall dimensions may also define the plate thickness T1 of the sector plate 400 (e.g., the height of edges 438 and 440).

The overall dimensions may be selected or determined based on user input, a desired sealing arrangement, properties of the rotor 34, and/or properties of the rotary regenerative heat exchanger 12. For example, overall dimensions may be determined by an algorithm that considers dimensions of the rotor 34 and a desired sealing arrangement (e.g., double sealing, quadruple sealing, etc.) for a particular rotary regenerative heat exchanger 12. Generally, sealing arrangements with larger number of seals may correspond to larger radial spans, but the radial length and/or plate thickness may depend on properties of the particular rotary regenerative heat exchanger 12 on which the sector plate 400 will be installed. Notably, rotors of different sizes operating in different conditions may experience different amounts of rotor turndown. Thus, to produce a sector plate that deforms parabolically to match rotor turndown, it may be important to properly determine the overall size of the sector plate based on characteristics (e.g., operating characteristics, temperature differentials, rotor speed, etc.) and properties (e.g., size, number of ducts, etc.) of a rotary heat exchanger.

Once the overall dimensions are determined in step 510, a number of tapered ribs 420 to be included on the top surface 402 is determined at step 520. This determination may be based on the surface area of the sector plate 400 and/or a desired sealing to be provided between rotor radial plates 341 and the bottom surface 430. For example, in some embodiments, the number of tapered ribs 420 may correlate directly to the sealing arrangement (e.g., with double or quadruple sealing requiring three tapered ribs 420, with triple or sextuple sealing requiring five tapered ribs 420, etc.). Alternatively, the sealing may dictate a maximum number of tapered ribs 420 and the specific number to be included can then be determined based on an algorithm that determines the number based on a stiffness needed for the sector plate 400 (as determined via a separate algorithm or a separate portion of an algorithm). The determination of the number of ribs may also depend on a material of the sector plate 400 and a temperature differential of the rotary regenerative heat exchanger 12 on which the sector plate 400 is to be installed. The material used may affect the weight, which may determine the natural sag and the temperature differential may dictate a needed parabolic deflection, which might affect how much the sector plate 400 can weigh.

For example, to achieve the running gap G shown in FIG. 13, the ideal stiffness of a sector plate 400 can be calculated based on rotor capping (or turndown) equations that define rotor deformation. Known capping equations for a specific rotary regenerative heat exchanger can be differentiated and input into static beam equations to define an ideal relationship between a bending moment for the sector plate 400 and a second moment of area for the sector plate 400, as shown in the following equations:

$$\frac{d^2y}{dx^2} = \frac{M(x)}{E \cdot I(x)} \rightarrow \frac{d^2y_r}{dx^2} = \frac{a_{ave}}{D_{RDP}} \cdot (T_{HE} - T_{CE}) = \frac{M(x)}{E \cdot I(x)} = \frac{M(x)}{E \cdot k \cdot M(x)} = \frac{1}{E \cdot k} = \text{constant}$$

In these equations, M(x) is the bending moment, E is Young's Modulus, I(x) is the Second Moment of Area, x is the radial position, Yr is the rotor capping, $D_{RDP}$ is the radial division plate depth, $a_{ave}$ is average coefficient of thermal expansion, $T_{HE}$ is the mean hot end metal temperature, $T_{CE}$ is the mean cold end metal temperature, and k is a scaling factor. Young's modulus may consider the thermal expansion for a specific material (e.g., mild steel) and mean hot end temperature. Meanwhile, capping equations may also consider temperature differential and moment equations may consider the weight and size of the sector plate 400. Thus, overall, these equations may consider temperature differential of a rotary regenerative heat exchanger 12 and the material and size of the sector plate 400.

Notably, to achieve a constant value, the second moment of area (I(x)) is a scaled version of the bending moment M(x) equation. That is, if M(x) is some n-th order polynomial, then I(x) should approximate the same polynomial multiplied by an arbitrary scaling factor (e.g., "k"). For example, if M(x) is a quadratic polynomial, then I(x) should also be a quadratic polynomial. This can be achieved with a specific number of tapered ribs 420, the thickness T2 and root height H1 of which can be determined based on an algorithm that achieves quadratic distribution for the second moment of area in view of the foregoing equations, as is described in further detail below in connection with step 520. Generally, these tapered ribs 420 provide a varied moment of inertia (e.g., modeled by a quadratic of equation) across a radial dimension (i.e., length) of the sector plate 400.

Still referring to FIG. 16, in some instances, the arrangement and/or thickness T2 of the tapered ribs 420 may also be determined at step 520. In many embodiments, the tapered ribs 420 have a constant thickness T2 and are to be evenly spaced and angled between the first edge 438 and the second edge 440 of the sector plate 400. Additionally or alternatively, a number and arrangement of lateral ribs 410 needed to support the tapered ribs 420 can be determined at 510. The number and arrangement of lateral ribs 410 may also depend on the surface area of the sector plate 400 and/or a desired sealing to be provided between rotor radial plates 341 and the bottom surface 430. Moreover, in some embodiments, different types of lateral ribs 410 can be selected to achieve a specific weight or support arrangement. For example, the lateral ribs 410 can be selected from I-beams, flat beams, L-shaped beams (facing first end 434 or second end 436) or C-shaped beams (facing first end 434 or second end 436).

As mentioned, at step 530, a root height H1 of the tapered ribs 420 is determined. At this point, the plate thickness T1 of the sector plate 400 and a number of tapered ribs 420 (N) included on the sector plate 400 may be known. Thus, adjusting the height H1 of the root end 421 of the tapered ribs 420 may directly control the overall second moment of area (I(x)), a cross sectional area of the tapered ribs 420, and a position of a neutral axis ($Y_o(x)$) of the sector plate 400, insofar as the neutral axis is indicative of the rest position of the sector plate 400 (and accounts for sag due to weight of the sector plate 400). In turn, these characteristics may define a deflection curve of the sector plate 400 when actuated to an actuated position, which controls the size of the running gap G between the bottom surface 430 of the sector plate 400 and the radial plates 341 of the rotor 34. Put another way, the height H1 of the root end 421 of the tapered ribs 420 may control the parabolic deformation of the sector plate 400 to minimize the running gap G between the bottom surface 430 of the sector plate 400 and the radial plates 341 of the rotor 34. Thus, generally, the height H1 of the root end 421 of the tapered ribs 420 is calculated to cause a parabolic deformation that is determined based on rotor temperatures and equations that model rotor turndown.

In at least some embodiments, the height H1 can be solved with one or more algorithms to provide a stiffness, and thus a deflection that matches the rotor deformation of a specific rotor 34 in a specific rotary regenerative heat exchanger 12. For example, the secant method can be implemented to determine H1 as follows:

$$H_1^n = H_1^{n-1} - f_{Gvar}\left(H_1^{n-1}\right) \cdot \frac{2 \cdot \Delta H_1}{f_{Gvar}\left(H_1^{n-1} + \Delta H_1\right) - f_{Gvar}\left(H_1^{n-1} - \Delta H_1\right)}$$

Alternatively, a range of values for H1, between $H_1$, and $H_{1,in}$, can be evaluated to give their associated running gaps G, and a curve can be fit to the running gap variations. In at least some embodiments, the maximum height for the root end 421 may be the height of fixed section 442 and the minimum height may be zero (e.g., indicating no tapered ribs 420). Then, a curve can be modeled along these points to allow interpolation that finds the value of $H_1$ that achieves the desired running gap G. For example, the curve may be built as follows:

$$[G_{var,min}: G_{var,max}] = f\, G_{var}([H_{1,min}: H_{1,max}])$$

In this equation, $G_{var}$ signifies the size of the running gap as a percentage of deviation.

Then, interpolation algorithms in mathematical modeling software can be used to interpolate between points and find the value of H1 that achieves the desired Gap Variation. However, if this method is used and the value of H1 is outside H1, and H1,ax, then the reported value will be NaN (Not a Number) and interpolation may be unable to be used. In these case, T2 may be altered (e.g., increased with step changes) to improve radial stiffness until the desired value of H1 is within $H_{1,n}$ and $H_{1,max}$. That is, at step 530, the thickness T2 can be iterated based on acceptable ranges of root height H1.

Figure 18:
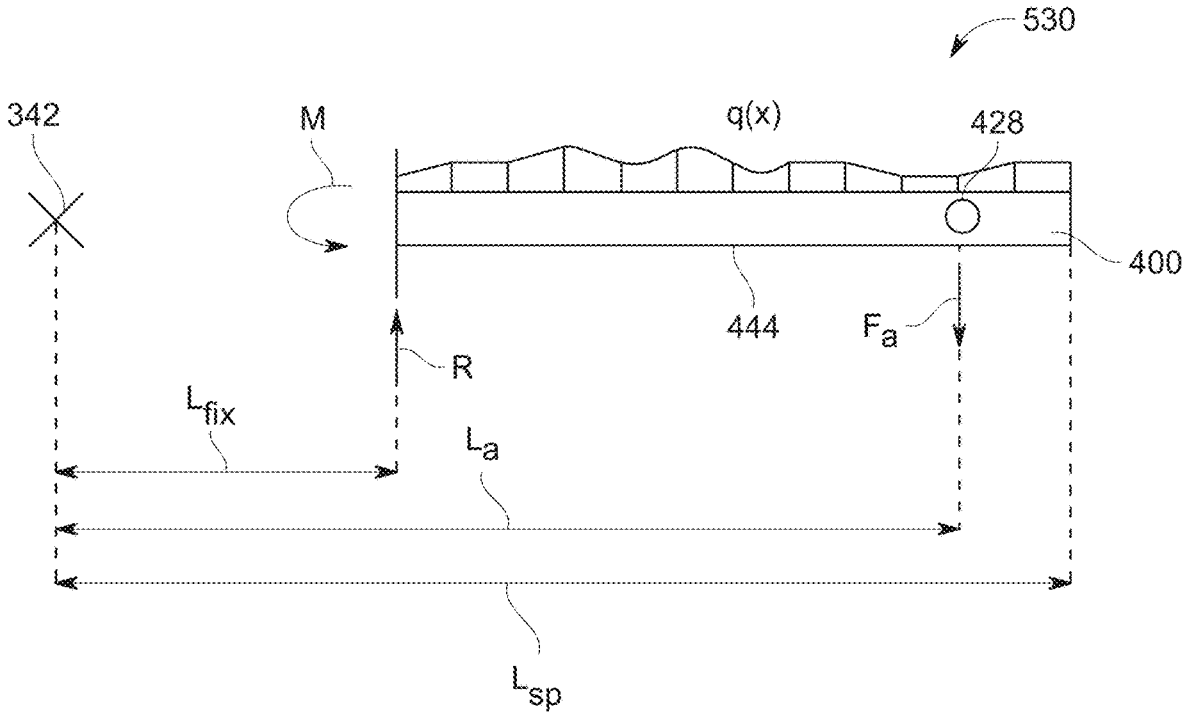

FIG. 18 illustrates at least some of these calculations and/or forces underlying these calculations schematically. In FIG. 18, $L_{fix}$ identifies the length of the fixed section 442 of the sector plate 400, La identifies the distance from the rotor hub 342 to the actuation points 428, and $L_{sp}$ identifies the overall radius of the sector plate 400. Meanwhile, Fa represents the actuator force that is applied at the actuation points 428 (acting downwards), R represents the reaction force generated where the fixed section 442 connects with the cantilevered section 444, and q(x) represents the distributed load across the cantilevered section 444. The bending moment generated by this load is represented by M.

Now turning back to FIG. 16, in some embodiments, further characteristics of the tapered ribs 420, beyond the number of tapered ribs 420 and the height $H_1$ of the tapered ribs 420 may also be determined for specific rotary regenerative heat exchangers (e.g., customized). For example, method 500 may include a step 540 to determine a length L1 and/or thickness T2 of the tapered ribs 420 (the thickness need not be constant). However, step 540 is depicted in dashed lines because this step may be optional. If step 540 is performed, the length L1 and/or thickness T may be determined based on the overall weight of the sector plate 400, the desired deflection/stiffness of the sector plate 400, and/or the sealing provided by the sector plate 400, similar to the manner discussed above in connection with step 530. This may ensure that the sector plate 400 deforms parabolically to minimize a gap G between the bottom surface 430 of the sector plate 400 and the radial plates 341 of the rotor 34. If step 540 is not performed, L1 may extend from the fixed section 442 to the actuation section 426 and the thickness T2 may be constant.

Figure 19:
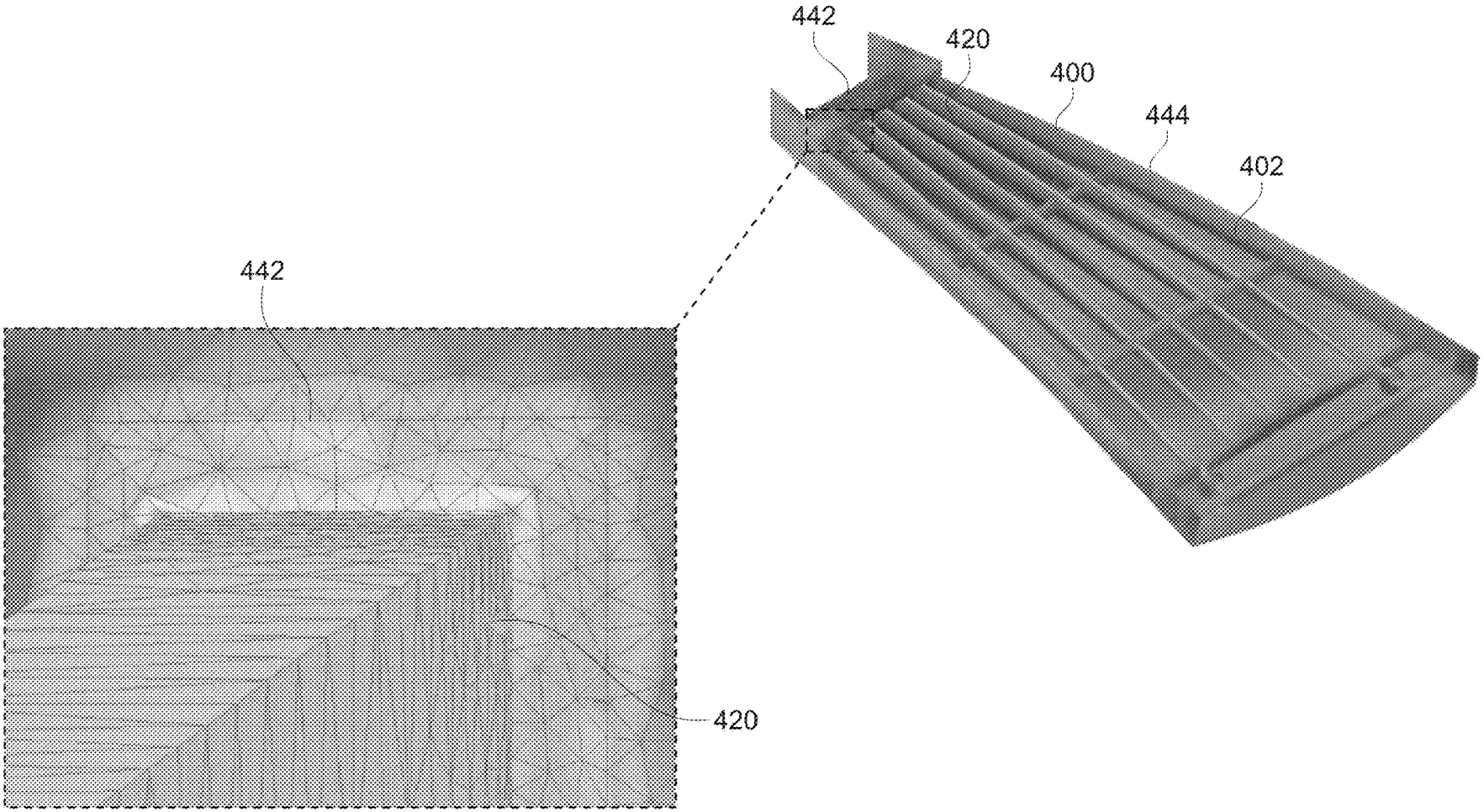
FIG. 19 is a diagram illustrating fatigue testing performed on the sector plate presented herein.

Now turning to FIG. 19, this Figure illustrates a fatigue analysis performed on the sector plate 400 presented herein. As can be seen, fatigue may peak at a connection point between the fixed section 442 and the root end 421 of the tapered ribs 420. However, through Finite Element Analysis and fatigue assessment, the fatigue life was found to be acceptable. For example, sector plates 400 of various sizes and for different rotary heat exchangers were analyzed in accordance with BS 7608 and found to be acceptable over millions of cycles.

FIG. 20 illustrates a table 600 demonstrating a leakage assessment of the sector plate 400 presented herein as compared to leakage from two prior sealing solutions (cold end sensor control and duct temperature control). Notably, whether the sector plate 400 is incorporated into a rotary regenerative heat exchanger 12 during installation/manufacture of a rotary regenerative heat exchanger or retrofitted onto an existing rotary regenerative heat exchanger 12, the sector plates 400 typically significantly reduce leakage (even relatively small leakages are considered significant for rotary regenerative heat exchangers). Moreover, the sector plate 400 was able to reduce leakage across various sealing arrangements (including double throughout, quadruple throughout, and double-triple arrangements), as well as bi-sector and tri-sector rotary regenerative heat exchangers (tri-sector being indicated by the presences of three sector plates (e.g., PA-Gas, SA-Gas, and PA-SA). In almost all of these scenarios, the sector plate 400 provides a reduction in hot end (HE) radial leakage, whilst using a much simpler more reliable control system (and, thus more inexpensive and easier to maintain).

Moreover, if the sector plates 400 are used in combination with hot end contact seals, the leakage is even further reduced. Notably, when contact seals have been used to try to close large running gaps, the seals needed to be very thin and extend significantly above their fixings. This extension renders the contact seals less resistant to fatigue from cyclic pressure differentials and/or supersonic steam jets from sootblowers, making the contact seals nearly unusable (due to rapid wear). Thus, contact seals are typically only suitable for closing small, even (e.g., consistent) gaps. On the other hand, the sector plates 400 presented herein create a small, consistent running gap G (e.g., as shown and described in connection with FIG. 13) and, thus, allow contact seals to be used. As can be seen in FIG. 20, contact seals may decrease overall leakage reduction up to 20% as compared to the sector plate 400 used without contact seals, but the precise benefit depends on specifics of the rotary heat exchanger.

Figure 21:
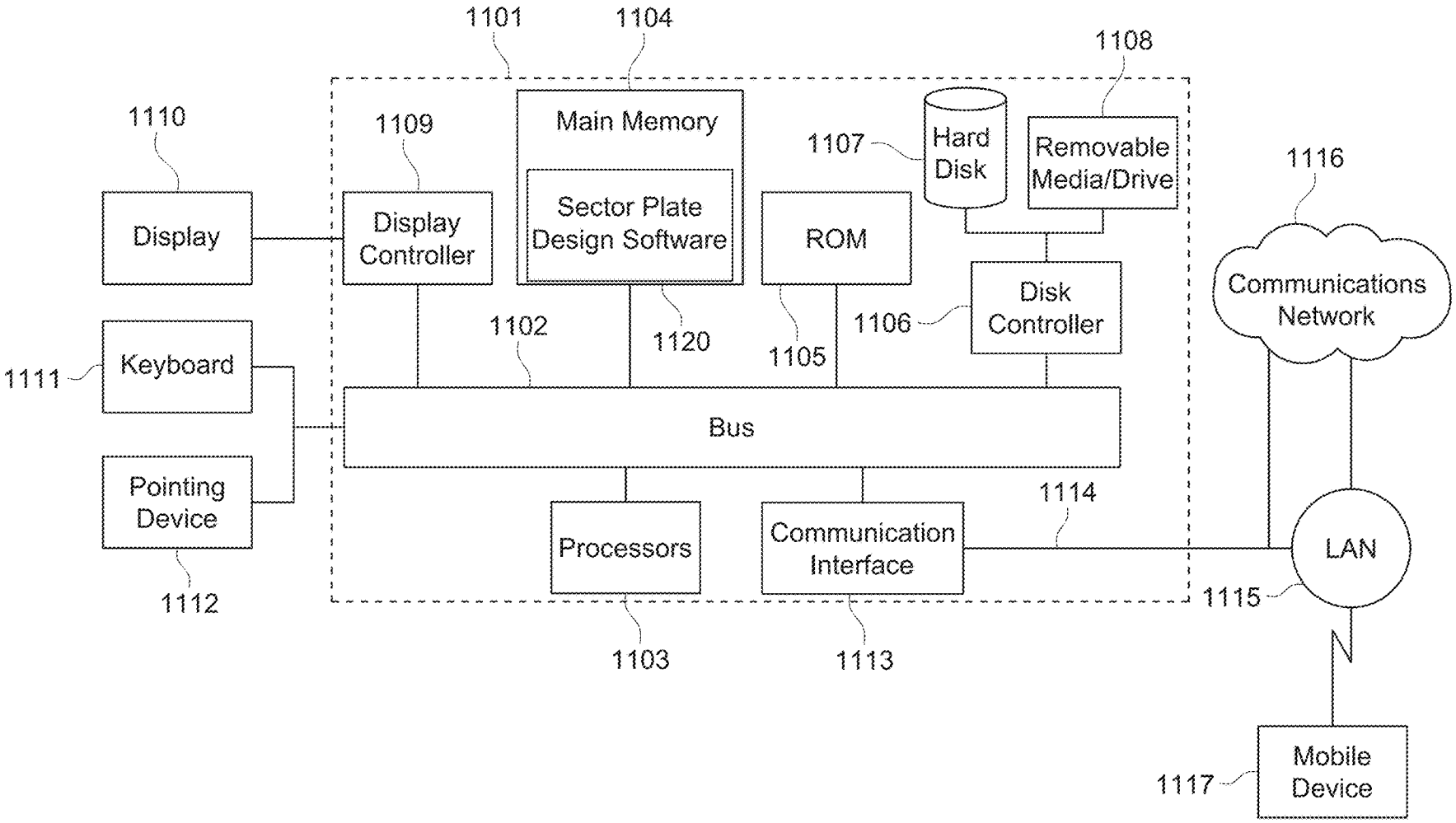
FIG. 21 is a simplified block diagram of a computing device that can be used to implement various embodiments of the disclosed technology, according to an example embodiment.

FIG. 21 illustrates an example hardware diagram of a computing apparatus 1101 on which the techniques (e.g., the techniques depicted in FIG. 16) provided herein may be implemented. The apparatus 1101 includes a bus 1102 or other communication mechanism for communicating information, and processor(s) 1103 coupled with the bus 1102 for processing the information. While the figure shows a signal block 1103 for a processor, it should be understood that the processors 1103 represent a plurality of processing cores, each of which can perform separate processing. The apparatus 1101 may also include special purpose logic devices (e.g., application specific integrated circuits (ASICs)) or configurable logic devices (e.g., simple programmable logic devices (SPLDs), complex programmable logic devices (CPLDs), and field programmable gate arrays (FPGAs)), that, in addition to microprocessors and digital signal processors, may individually or collectively, act as processing circuitry. The processing circuitry may be located in one device or distributed across multiple devices.

The apparatus 1101 also includes a main memory 1104, such as a random access memory (RAM) or other dynamic storage device (e.g., dynamic RAM (DRAM), static RAM (SRAM), and synchronous DRAM (SD RAM)), coupled to the bus 1102 for storing information and instructions to be executed by processor(s) 1103. The memory 1104 stores sector plate design software 1120 that, when executed by the processor(s) 1103, enables the computing apparatus 1101 to perform the operations described herein. In addition, the main memory 1104 may be used for storing temporary variables or other intermediate information during the execution of instructions by the processor 1103. The apparatus 1101 further includes a read only memory (ROM) 1105 or other static storage device (e.g., programmable ROM (PROM), erasable PROM (EPROM), and electrically erasable PROM (EEPROM)) coupled to the bus 1102 for storing static information and instructions for the processor 1103.

The apparatus 1101 also includes a disk controller 1106 coupled to the bus 1102 to control one or more storage devices for storing information and instructions, such as a magnetic hard disk 1107, and a removable media drive 1108 (e.g., floppy disk drive, read-only compact disc drive, read/write compact disc drive, compact disc jukebox, tape drive, and removable magneto-optical drive). The storage devices may be added to the apparatus 1101 using an appropriate device interface (e.g., small computer system interface (SCSI), integrated device electronics (IDE), enhanced-IDE (E-IDE), direct memory access (DMA), or ultra-DMA). Thus, in general, the memory may comprise one or more tangible (non-transitory) computer readable storage media (e.g., a memory device) encoded with software comprising computer executable instructions and when the software is executed (by the processor) it is operable to perform the operations described herein.

The apparatus 1101 may also include a display controller 109 coupled to the bus 1102 to control a display 1110, such as a cathode ray tube (CRT), for displaying information to a computer user. The computer system 1101 may also include input devices, such as a keyboard 1111 and a pointing device 1112, for interacting with a computer user and providing information to the processor 1103. The pointing device 1112, for example, may be a mouse, a trackball, or a pointing stick for communicating directional information and command selections to the processor 1103 and for controlling cursor movement on the display 1110. In addition, a printer may provide printed listings of data stored and/or generated by the apparatus 1101.

The apparatus 1101 performs a portion or all of the processing steps described herein in response to the processor 1103 executing one or more sequences of one or more instructions contained in a memory, such as the main memory 1104. Such instructions may be read into the main memory 1104 from another computer readable medium, such as a hard disk 1107 or a removable media drive 1108. One or more processors in a multi-processing arrangement may also be employed to execute the sequences of instructions contained in main memory 1104. In alternative embodiments, hard-wired circuitry may be used in place of or in combination with software instructions. Thus, embodiments are not limited to any specific combination of hardware circuitry and software.

As stated above, the apparatus 1101 includes at least one computer readable medium or memory for holding instructions programmed according to the embodiments presented, for containing data structures, tables, records, or other data described herein. Examples of computer readable media are compact discs, hard disks, floppy disks, tape, magneto-optical disks, PROMs (EPROM, EEPROM, flash EPROM), DRAM, SRAM, SD RAM, or any other magnetic medium, compact discs (e.g., CD-ROM), or any other optical medium, punch cards, paper tape, or other physical medium with patterns of holes, or any other medium from which a computer can read.

Stored on any one or on a combination of non-transitory computer readable storage media, embodiments presented herein include software for controlling the apparatus 1101, for driving a device or devices for implementing the techniques presented herein, and for enabling the apparatus 1101 to interact with a human user (e.g., network engineers). Such software may include, but is not limited to, device drivers, operating systems, development tools, and applications software. Such computer readable storage media further includes a computer program product for performing all or a portion (if processing is distributed) of the processing presented herein.

The computer code devices may be any interpretable or executable code mechanism, including but not limited to scripts, interpretable programs, dynamic link libraries (DLLs), Java classes, and complete executable programs. Moreover, parts of the processing may be distributed for better performance, reliability, and/or cost.

The apparatus 1101 also includes a communication interface 1113 coupled to the bus 1102. The communication interface 1113 provides a two-way data communication coupling to a network link 1114 that is connected to, for example, a local area network (LAN) 1115, or to another communications network 1116 such as the Internet. For example, the communication interface 1113 may be a wired or wireless network interface card to attach to any packet switched (wired or wireless) LAN. As another example, the communication interface 1113 may be an asymmetrical digital subscriber line (ADSL) card, an integrated services digital network (ISDN) card or a modem to provide a data communication connection to a corresponding type of communications line. Wireless links may also be implemented. In any such implementation, the communication interface 1113 sends and receives electrical, electromagnetic or optical signals that carry digital data streams representing various types of information.

The network link 1114 typically provides data communication through one or more networks to other data devices. For example, the network link 1114 may provide a connection to another computer through a local are network 1115 (e.g., a LAN) or through equipment operated by a service provider, which provides communication services through a communications network 1116. The local network 1114 and the communications network 1116 use, for example, electrical, electromagnetic, or optical signals that carry digital data streams, and the associated physical layer (e.g., CAT 5 cable, coaxial cable, optical fiber, etc.). The signals through the various networks and the signals on the network link 1114 and through the communication interface 1113, which carry the digital data to and from the apparatus 1101 may be implemented in baseband signals, or carrier wave based signals. The baseband signals convey the digital data as unmodulated electrical pulses that are descriptive of a stream of digital data bits, where the term "bits" is to be construed broadly to mean symbol, where each symbol conveys at least one or more information bits. The digital data may also be used to modulate a carrier wave, such as with amplitude, phase and/or frequency shift keyed signals that are propagated over a conductive media, or transmitted as electromagnetic waves through a propagation medium. Thus, the digital data may be sent as unmodulated baseband data through a "wired" communication channel and/or sent within a predetermined frequency band, different than baseband, by modulating a carrier wave. The apparatus 1101 can transmit and receive data, including program code, through the network(s) 1115 and 1116, the network link 1114 and the communication interface 1113. Moreover, the network link 1214 may provide a connection through a LAN 1115 to a mobile device 1117 such as a personal digital assistant (PDA) laptop computer, or cellular telephone.

The sector plate and associated design techniques presented herein provide a number of advantages. Most notably, the sector plate offers an effective sealing system that can reduce leakage while also reducing costs of manufacturing and/or installation. The effective sealing reduces leakage, which improves the efficiency of the rotary regenerative heat exchanger as well as a boiler (or an emissions reduction plant) connected thereto. Moreover, since the sector plate presented herein does not require rollers, bearings, cooling and/or lubrication systems, and the like, little to no maintenance is required for the sector plate presented herein.

It may also be very easy to retrofit the sector plate presented herein onto existing rotary regenerative heat exchangers, at least because there is no need to modify the rotor or outer housing of the rotary regenerative heat exchanger during a retrofit (e.g., no need to cut holes in a housing for installation of a cooling/lubrication system). That said, the sector plate presented herein is still actuated/modulated and, thus, can satisfy customer requirements for actuated sector plates, which are now common. Additionally, among other advantages, the techniques for designing the sector plate presented herein allow quick customization of the sector plates on a per-job basis, which ensures that the sector plates function optimally for each and every rotary regenerative heat exchanger on which they are installed.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

It is also to be understood that the sector plate described herein, or portions thereof may be fabricated from any suitable material or combination of materials, such as metals or synthetic materials including, but not limited to, plastic, rubber, derivatives thereof, and combinations thereof. It is also intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially".

The invention claimed is:

1. A method for producing a sector plate for a rotary heat exchanger comprising:

defining overall dimensions of a sector plate, the overall dimensions defining a surface area of a top surface and a bottom surface of the sector plate, the bottom surface being configured to be positioned across a radial dimension of a rotor of a rotary heat exchanger so that the bottom surface can form one or more seals with one or more radial plates of the rotor during operation of the rotor;

determining a number of a plurality of tapered ribs to be included on the top surface, the number being determined based on the surface area and a desired sealing to be provided between the one or more radial plates and the bottom surface; and determining a root height of the plurality of tapered ribs based on a plate thickness of the sector plate and the number of the plurality of tapered ribs, wherein, with the root height, the plurality of tapered ribs cause a parabolic deformation of the sector plate to an actuated position in response to an actuation load to minimize a running gap between the bottom surface and the one or more radial plates, and wherein the plurality of tapered ribs return the sector plate to a rest position in response to removal of the actuation load, with the sector plate supporting its weight in a cantilevered fashion when in the actuated position and the rest position.

2. The method of claim 1, wherein the number of the plurality of tapered ribs is capped at three for double sealing or quadruple sealing and the number of the plurality of tapered ribs is capped at five for triple sealing or sextuple sealing.

3. The method of claim 1, wherein the determining of the root height is further based on a material, wherein the material, the surface area, and the plate thickness can be used to calculate the weight of the sector plate.

4. The method of claim 3, wherein the weight of the sector plate is unsupported at a distal end of the sector plate during operations of the rotary heat exchanger.

5. The method of claim 1, wherein the root height and the number of the plurality of tapered ribs control a stiffness of the sector plate, thereby controlling the parabolic deformation to minimize the running gap.

6. The method of claim 5, wherein a rib thickness of the plurality of tapered ribs is iterated based on the root height.

7. The method of claim 1, wherein defining the overall dimensions of the sector plate comprises:

determining the overall dimensions based on: (a) a sealing arrangement to be provided in the rotary heat exchanger; (b) a number of sections included in the rotary heat exchanger; (c) a size of the rotary heat exchanger; or (d) any combination of (a), (b), and (c).

8. The method of claim 1, further comprising:

defining a fixed section of the sector plate, the fixed section extending from a first end of the sector plate that engages a rotor hub of the rotary heat exchanger; and defining a cantilevered section of the sector plate, the cantilevered section extending from the fixed section to a distal end of the sector plate, the plurality of tapered ribs extending radially through at least a portion of the cantilevered section.

9. The method of claim 1, wherein the actuation load acts in only a downward direction.

10. The method of claim 9, further comprising:

defining an actuation section disposed at a distal end of the top surface, the actuation section being configured to receive the actuation load.

11. The method of claim 10, wherein the actuation section includes one or more actuation points that are equally spaced between traverse ribs that extend laterally with respect to the plurality of tapered ribs.

12. The method of claim 11, wherein the one or more actuation points comprise a pair of actuation points that are equally spaced from a first edge and a second edge of the sector plate.

13. The method of claim 10, wherein the sector plate is a sector of a circle and the actuation section comprises an arc or annular section of the sector.

14. The method of claim 1, wherein the sector plate is a sector of a circle with a first edge and a second edge and the method further comprises:

arranging the plurality of tapered ribs to be equally spaced between the first edge and the second edge.

15. An apparatus for producing a sector plate for a rotary heat exchanger comprising:

one or more network interface units configured to enable network connectivity; and a processor configured to:

define overall dimensions of a sector plate, the overall dimensions defining a surface area of a top surface and a bottom surface of the sector plate, the bottom surface being configured to be positioned across a radial dimension of a rotor of a rotary heat exchanger so that the bottom surface can form one or more seals with one or more radial plates of the rotor during operation of the rotor;

determine a number of a plurality of tapered ribs to be included on the top surface, the number being determined based on the surface area and a desired sealing to be provided between the one or more radial plates and the bottom surface; and determine a root height of the plurality of tapered ribs based on a plate thickness of the sector plate and the number of the plurality of tapered ribs, wherein, with the root height, the plurality of tapered ribs cause a parabolic deformation of the sector plate to an actuated position in response to an actuation load to minimize a running gap between the bottom surface and the one or more radial plates, and wherein the plurality of tapered ribs return the sector plate to a rest position in response to removal of the actuation load, with the sector plate supporting its weight in a cantilevered fashion when in the actuated position and the rest position.

16. The apparatus of claim 15, wherein the processor also determines the root height based on a material, wherein the material, the surface area, and the plate thickness can be used to calculate the weight of the sector plate.

17. The apparatus of claim 15, wherein the weight of the sector plate is unsupported at a distal end of the sector plate during operations of the rotary heat exchanger.

18. The apparatus of claim 15, wherein the root height and number of the plurality of tapered ribs control a stiffness of the sector plate, thereby controlling the parabolic deformation to minimize the running gap.

19. One or more non-transitory computer readable storage media encoded with instructions that, when executed by a processor, cause the processor to:

define overall dimensions of a sector plate, the overall dimensions defining a surface area of a top surface and a bottom surface of the sector plate, the bottom surface being configured to be positioned across a radial dimension of a rotor of a rotary heat exchanger so that the bottom surface can form one or more seals with one or more radial plates of the rotor during operation of the rotor;

determine a number of a plurality of tapered ribs to be included on the top surface, the number being determined based on the surface area and a desired sealing to be provided between the one or more radial plates and the bottom surface; and determine a root height of the plurality of tapered ribs based on a plate thickness of the sector plate and the number of the plurality of tapered ribs, wherein, with the root height, the plurality of tapered ribs cause a parabolic deformation of the sector plate to an actuated position in response to an actuation load to minimize a running gap between the bottom surface and the one or more radial plates, and wherein the plurality of tapered ribs return the sector plate to a rest position in response to removal of the actuation load, with the sector plate supporting its weight in a cantilevered fashion when in the actuated position and the rest position.

20. The non-transitory computer readable storage media of claim 19, wherein the determining of the root height is further based on a material, wherein the material, the surface area, and the plate thickness indicate the weight of the sector plate.

* * * * *